US007198109B2

(12) United States Patent
Turner et al.

(10) Patent No.: US 7,198,109 B2
(45) Date of Patent: Apr. 3, 2007

(54) DOUBLE-PIN RADIAL FLOW VALVE

(75) Inventors: Dewayne Turner, Tomball, TX (US); Richard J. Ross, Houston, TX (US)

(73) Assignee: BJ Services Company, Houston, TX (US)

( * ) Notice: Subject to any disclaimer, the term of this patent is extended or adjusted under 35 U.S.C. 154(b) by 0 days.

(21) Appl. No.: 10/364,941

(22) Filed: Feb. 12, 2003

(65) Prior Publication Data

US 2003/0221839 A1 Dec. 4, 2003

Related U.S. Application Data

(63) Continuation-in-part of application No. 10/004,956, filed on Dec. 5, 2001, now Pat. No. 6,722,440, application No. 10/364,941, which is a continuation-in-part of application No. 09/378,384, filed on Aug. 20, 1999, now Pat. No. 6,397,949.

(60) Provisional application No. 60/251,293, filed on Dec. 5, 2000, provisional application No. 60/097,449, filed on Aug. 21, 1998.

(51) Int. Cl.
*E21B 34/06* (2006.01)
*E21B 34/10* (2006.01)

(52) U.S. Cl. ..... 166/374; 166/386; 166/323; 166/334.1

(58) Field of Classification Search ..... 166/319, 166/320, 321, 323, 332.1, 334.1, 373, 374, 166/386; 137/624.27, 494
See application file for complete search history.

(56) References Cited

U.S. PATENT DOCUMENTS 2,963,089 A 12/1960 Sizer
3,051,243 A 8/1962 Grimmer et al.
3,627,049 A 12/1971 Young
3,741,249 A 6/1973 Leutwyler
3,741,300 A 6/1973 Wolff et al.
3,749,119 A * 7/1973 Tausch et al. ..... 137/461

(Continued)

FOREIGN PATENT DOCUMENTS

WO WO 97/36089 10/1997

OTHER PUBLICATIONS

Model "B" Multi-Reverse Circulating Valc; Baker Hughes—Tubing Conveyed Perforating Technical Unit; Jun. 1997.

(Continued)

*Primary Examiner*—Jennifer H. Gay
(74) *Attorney, Agent, or Firm*—Locke Liddell & Sapp LLP

(57) ABSTRACT

A valve with the following components: a pipe; an inner sub connected to the pipe; an outer sub connected to the pipe, wherein the inner and outer subs are concentric and define a sub annulus; a conduit between the sub annulus and an inside diameter of the inner sub; a sleeve slideably positioned within the pipe such that in at least one position the sleeve closes the conduit, wherein the sleeve comprises a section of relatively larger outside diameter and a section of relatively smaller outside diameter which define a pressure area on the sleeve between the diameters; and a lock of the sleeve in a position which closes the conduit. A method for controlling fluid flow through a conduit between an annulus defined by inner and outer subs and an interior of the inner sub, the method having several steps: unlocking a sleeve positioned within the inner sub in a first closure position relative to the conduit by sliding the sleeve from the first closure position to a second closure position relative to the conduit; and opening the conduit by sliding the sleeve from the second closure position to an open position relative to the conduit.

28 Claims, 45 Drawing Sheets

U.S. PATENT DOCUMENTS 3,763,933 A 10/1973 Mott
3,771,603 A 11/1973 Crowe
3,786,866 A * 1/1974 Tausch et al. ..... 166/322
3,814,181 A * 6/1974 Young ..... 166/324
3,814,183 A 6/1974 Kishel
3,823,773 A * 7/1974 Nutter ..... 166/336
3,845,815 A * 11/1974 Garwood ..... 166/154
3,856,085 A 12/1974 Holden et al.
3,882,935 A * 5/1975 Calhoun ..... 166/322
3,970,147 A * 7/1976 Jessup et al. ..... 166/374
3,993,130 A * 11/1976 Papp ..... 166/330
4,040,488 A 8/1977 Nelson
4,113,012 A 9/1978 Evans et al.
4,143,712 A 3/1979 James et al.
4,144,937 A 3/1979 Jackson et al.
4,189,003 A 2/1980 James et al.
4,280,561 A 7/1981 Fredd
4,319,634 A 3/1982 McMahan et al.
4,383,578 A * 5/1983 Baker ..... 166/373
4,388,968 A * 6/1983 Brandell ..... 166/236
4,399,870 A 8/1983 Baugh et al.
4,403,659 A 9/1983 Upchurch
4,415,038 A 11/1983 Schmuck
4,420,043 A * 12/1983 Brooks ..... 166/319
4,429,747 A * 2/1984 Williamson, Jr. ..... 166/321
4,452,313 A 6/1984 McMahan
4,498,536 A 2/1985 Ross et al.
4,560,005 A * 12/1985 Helderle et al. ..... 166/332.2
4,605,062 A 8/1986 Klumpyan et al.
4,627,492 A 12/1986 MacLaughlin
4,749,044 A * 6/1988 Skipper et al. ..... 166/323
4,903,775 A 2/1990 Manke
4,915,175 A 4/1990 Mashaw, Jr.
4,928,772 A * 5/1990 Hopmann ..... 166/386
4,940,093 A * 7/1990 Hilsman, III ..... 166/319
4,967,845 A * 11/1990 Shirk ..... 166/386
5,010,955 A 4/1991 Springer
5,090,481 A 2/1992 Pleasants et al.
5,137,088 A * 8/1992 Farley et al. ..... 166/319
5,180,007 A * 1/1993 Manke et al. ..... 166/321
5,180,016 A * 1/1993 Ross et al. ..... 166/387
5,183,115 A 2/1993 Gano
5,226,494 A * 7/1993 Rubbo et al. ..... 166/250.17
5,240,071 A * 8/1993 Shaw et al. ..... 166/319
5,257,663 A 11/1993 Pringle et al.
5,263,683 A 11/1993 Wong
5,287,930 A 2/1994 McGill
5,295,538 A 3/1994 Restarick
5,373,899 A 12/1994 Dore et al.
5,377,750 A 1/1995 Arterbury et al.
5,413,180 A * 5/1995 Ross et al. ..... 166/387
5,456,322 A 10/1995 Tucker et al. ..... 166/386
5,518,073 A 5/1996 Manke et al.
5,558,162 A 9/1996 Manke et al.
5,597,042 A 1/1997 Tubel et al.
5,609,178 A 3/1997 Hennig et al.
5,609,204 A * 3/1997 Rebardi et al. ..... 166/51
5,676,208 A 10/1997 Finley
5,730,223 A 3/1998 Restarick
5,775,421 A 7/1998 Duhon et al.
5,810,087 A 9/1998 Patel
5,826,662 A 10/1998 Beck et al.
5,865,251 A 2/1999 Rebardi et al.
5,890,540 A 4/1999 Pia et al.
5,901,796 A 5/1999 McDonald
5,909,769 A 6/1999 Duhon et al.
5,950,733 A 9/1999 Patel
6,125,930 A 10/2000 Moyes
6,148,915 A 11/2000 Mullen et al.
6,148,919 A * 11/2000 Burris et al. ..... 166/319
6,220,357 B1 4/2001 Carmichael et al. ..... 166/321
6,220,360 B1 4/2001 Connell et al.
6,227,298 B1 5/2001 Patel ..... 166/321
6,230,808 B1 5/2001 French et al.
6,302,216 B1 10/2001 Patel
6,352,119 B1 3/2002 Patel
6,386,289 B1 * 5/2002 Patel ..... 166/325
6,397,949 B1 * 6/2002 Walker et al. ..... 166/374
6,446,729 B1 * 9/2002 Bixenman et al. ..... 166/386
6,520,257 B2 2/2003 Allamon et al.
6,575,246 B2 6/2003 Bixenman et al.
6,634,429 B2 10/2003 Henderson et al.
6,659,186 B2 12/2003 Patel
6,662,877 B2 12/2003 Patel
6,684,950 B2 2/2004 Patel
6,722,440 B2 * 4/2004 Turner et al. ..... 166/374
6,763,892 B2 * 7/2004 Kaszuba ..... 166/373
2001/0013415 A1 * 8/2001 Mullen et al. ..... 166/374
2001/0030049 A1 * 10/2001 Patel ..... 166/386
2002/0074128 A1 * 6/2002 Allamon et al. ..... 166/373
2002/0189814 A1 * 12/2002 Freiheit et al. ..... 166/373
2004/0094303 A1 5/2004 Brockman et al.
2004/0094304 A1 * 5/2004 Turner et al. ..... 166/313

OTHER PUBLICATIONS

Weatherford, Completion Isolation Valve, www.weatherford.com, printed Nov. 26, 2002, 3 pages, internet.
Weatherford, Technical Data Manual, printed Oct. 20, 2001, 39 pages, internet.
Weatherford, CIV/RM , 2001, 2 pages.
Weatherford, CIV/RM, Jul. 3, 2000, 10 pages.
Schlumberger, FIV Technology, SMP5836, Feb. 2003, 8 pages.
Schlumberger, Downhole Valve reduces formation damage in sand-cnntrol completions, www.slb.com, Nov. 25, 2002, 2 pages.
Schlumberger, Oilfiled Bulletin: Focus on Completions, date unknown, 3 pages.
Osca, HPR-150 System, Technical Bulletin, 2000, 2 pages.
Baker Hughes, Model CMP Non-elastomeric Circulating Sliding Sleeve, Flow Control, Aug. 1997, 4 pages.
Baker Hughes, Models CD 6000 and CU 6000 Sliding Sleeves, Flow Control Systems, undated, pp. 52-55 (4 pgs.), Baker Hughes.

* cited by examiner

SECTION 'A-A'

DOUBLE-PIN RADIAL FLOW VALVE

CONTINUATION STATEMENT

This is a continuation-in-part of application Ser. No. 10/004,956, filed 5 Dec. 2001, now U.S. Pat. No. 6,722,440, which claims the benefit of U.S. Provisional Application Ser. No. 60/251,293, filed 5 Dec. 2000. This is also a continuation-in-part of application Ser. No. 09/378,384, filed 20 Aug. 1999, now U.S. Pat. No. 6,397,949, which claims the benefit of U.S. Provisional Application Ser. No. 60/097,449, filed 21 Aug. 1998.

BACKGROUND OF THE INVENTION

The present invention relates to the field of well completion assemblies for use in a wellbore. More particularly, the invention provides a method and apparatus for controlling fluid flow between an annulus and an interior of a production zone isolation system.

The need to drain multiple-zone reservoirs with marginal economics using a single well bore has driven new downhole tool technology. While many reservoirs have excellent production potential, they cannot support the economic burden of an expensive deepwater infrastructure. Operators needed to drill, complete and tieback subsea completions to central production facilities and remotely monitor, produce and manage the drainage of multiple horizons. This requires rig mobilization (with its associated costs running into millions of dollars) to shut off or prepare to produce additional zones from the central production facility.

A problem with existing technology is its inability to complete two or more zones in a single well while addressing fluid loss control to the upper zone when running the well completion hardware. In the past, expensive and often undependable chemical fluid loss pills were spotted to control fluid losses into the reservoir after perforating and/or sand control treatments. A concern with this method when completing upper zones is the inability to effectively remove these pills, negatively affecting the formation and production potential and reducing production efficiency. Still another problem is economically completing and producing from different production zones at different stages in a process, and in differing combinations. The existing technology dictates an inflexible order of process steps for completion and production.

Prior systems required the use of a service string, wire line, coil tubing, or other implement to control the configuration of isolation valves. Utilization of such systems involves positioning of tools down-hole. Certain disadvantages have been identified with the systems of the prior art. For example, prior conventional isolation systems have had to be installed after the gravel pack, thus requiring greater time and extra trips to install the isolation assemblies. Also, prior systems have involved the use of fluid loss control pills after gravel pack installation, and have required the use of through-tubing perforation or mechanical opening of a wireline sliding sleeve to access alternate or primary producing zones. In addition, the installation of prior systems within the wellbore require more time consuming methods with less flexibility and reliability than a system which is installed at the surface. Each trip into the wellbore adds additional expense to the well owner and increases the possibility that tools may become lost in the wellbore requiring still further operations for their retrieval.

While pressure actuated valves have been used in certain situations, disadvantages have been identified with such devices. For example, prior valves are disassociated from other elements of an isolation system and are simply "made-up" to the other components. Because each of the components are made-up to each other, the length of the overall system becomes undesirably long. Further, the prior valves are typically run-in the well with the valve biased in a closed configuration, such that tubing pressure is then used to open the valve after being properly positioned down hole. A basic failing of these valves is that operators are unable to pressure activate multiple valve because the first valve to open will relieve the tubing pressure necessary to open the remainder of the valves.

There has therefore remained a need for an pressure activated valve for well control purposes and for wellbore fluid loss control, which combines simplicity, reliability, safety and economy, while also affording flexibility in use.

SUMMARY OF THE INVENTION

The present invention provides a system which allows an operator to pressure activate a valve, or multiple valves in a single pressure cycle. Such valves allow operators to perforate, complete, and produce multiple production zones from a single well in a variety of ways allowing flexibility in the order of operation. Valves of the present invention do not require tools to shift the valve and allows the use of multiple pressure actuated valves in a production assembly.

According to one aspect of the invention, after a zone is completed, total mechanical fluid loss is maintained and the pressure-actuated circulating (PAC) and/or pressure-actuated device (PAD) valves are opened with pressure from the surface when ready for production. This eliminates the need to rely on damaging and sometimes non-reliable fluid loss pills being spotted in order to control fluid loss after the frac or gravel pack on an upper zone (during the extended time process of installing completion production hardware).

According to another aspect of the present invention, the economical and reliable exploitation of deepwater production horizons that were previously not feasible are within operational limits of systems incorporating valves of the invention.

A further aspect of the invention provides valve which may be controlled by generating a pressure differential between the valve interior and exterior.

According to an aspect of the invention, there is provided a valve having the following components: a pipe; an inner sub connected to the pipe; an outer sub connected to the pipe, wherein a sub annulus is defined by the inner and outer subs; a conduit between the sub annulus and an interior of the inner sub; a closure of the conduit, wherein the closure is configurable in at least locked-closed, unlocked-closed and open configurations, wherein the closure closes the conduit in the locked-closed and unlocked-closed configurations and the closure does not close the conduit in the open configuration; and a lock which locks the closure in the locked-closed configuration.

According to another aspect of the invention, there is a valve with the following components: a pipe; an inner sub connected to the pipe; an outer sub connected to the pipe, wherein the inner and outer subs are concentric and define a sub annulus; a conduit between the sub annulus and an inside diameter of the inner sub; a sleeve slideably positioned within the pipe such that in at least one position the sleeve closes the conduit, wherein the sleeve comprises a section of relatively larger outside diameter and a section of relatively smaller outside diameter which define a pressure area on the sleeve between the diameters; and a lock of the sleeve in a position which closes the conduit.

According to still a further aspect of the invention, there is provided a method for controlling fluid flow through a conduit between an annulus defined by inner and outer subs and an interior of the inner sub, the method having several steps: unlocking a sleeve positioned within the inner sub in a first closure position relative to the conduit by sliding the sleeve from the first closure position to a second closure position relative to the conduit; and opening the conduit by sliding the sleeve from the second closure position to an open position relative to the conduit.

BRIEF DESCRIPTION OF THE DRAWINGS

The present invention is better understood by reading the following description of non-limitative embodiments with reference to the attached drawings wherein like parts in each of the several figures are identified by the same reference characters, and which are briefly described as follows.

Figure 1A:
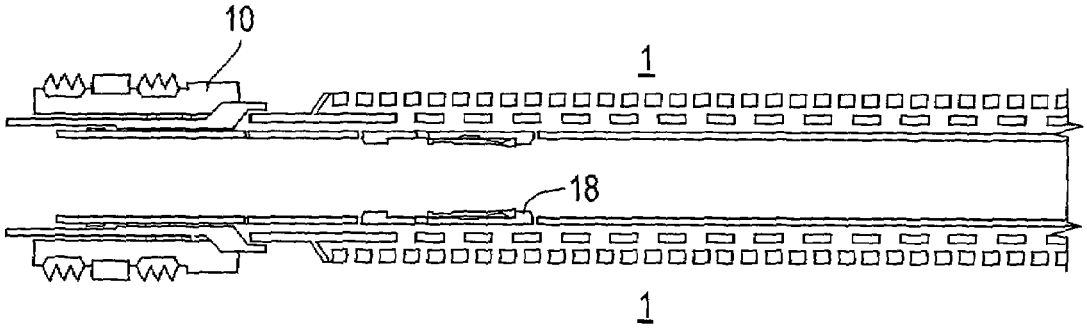
FIGS. 1A through 1I illustrate a cross-sectional, side view of first and second isolation strings.
Figure 2A:
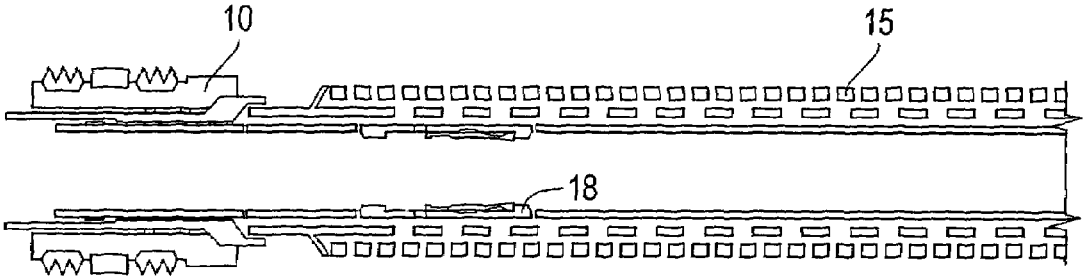
FIGS. 2A through 2L illustrate a cross-sectional, side view of first, second and third isolation strings, wherein the first and second strings co-mingle production fluids.
Figure 3A:
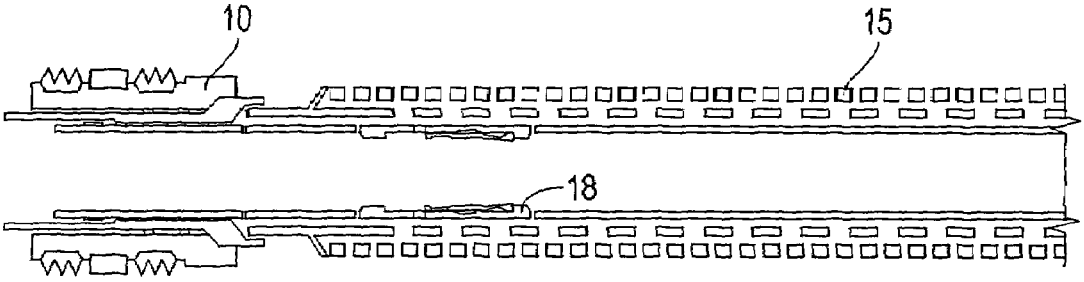
FIGS. 3A through 3K illustrate a cross-sectional, side view of first, second and third isolation strings, wherein the second and third strings co-mingle production fluids.

It is to be noted, however, that the appended drawings illustrate only typical embodiments of this invention and are therefore not to be considered limiting of its scope, as the invention may admit to other equally effective embodiments.

DETAILED DESCRIPTION OF THE INVENTION

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIGS. 1A through 1I, there is shown a system for production over two separate zones, wherein the uphole end is on the right and the downhold end is on the left. A first isolation string 11 is placed adjacent the first production zone 1. A second isolation string 22 extends across the second production zone 2. The first isolation string 11 enables gravel pack, fracture and isolation procedures to be performed on the first production zone 1 before the second isolation string 22 is placed in the well. After the first production zone 1 is isolated, the second isolation string 22 is stung into the first isolation string 11. Without running any tools on wire line or coil tubing to manipulate any of the valves, the second isolation string 22 enables gravel pack, fracture and isolation of the second production zone 2. The first and second isolation strings 11 and 22 operate together to allow simultaneous production of zones 1 and 2 without co-mingling the production fluids. The first production zone 1 produces fluid through the interior of the production pipe or tubing 5 while the second production zone 2 produces fluid through the annulus between the production tubing 5 and the well casing (not shown).

The first isolation string 11 comprises a production screen 15 which is concentric about a base pipe 16. At the lower end of the base pipe 16 there is a lower packer 10 for engaging the first isolation string 11 in the well casing (not shown). Within the base pipe 16, there is a isolation or wash pipe 17 which has an isolation valve 18 therein. A pressure-actuated device (PAD) valve 12 is attached to the tops of both the base pipe 16 and the isolation pipe 17. The PAD valve 12 allows fluid communication through the annuluses above and below the PAD valve. A pressure-actuated circulating (PAC) valve 13 is connected to the top of the PAD valve 12. The PAC valve allows fluid communication between the annulus and the center of the string. Further, an upper packer 19 is attached to the exterior of the PAD valve 12 through a further section of base pipe 16. This section of base pipe 16 has a cross-over valve 21 which is used to communicate fluid between the inside and outside of the base pipe 16 during completion operations.

Once the first isolation string 11 is set in the well casing (not shown) by engaging the upper and lower packers 19 and 10, fracture and gravel pack operations are conducted or may be conducted on the first production zone. The PAD valve and PAC valve are in a locked closed configuration while the isolation valve 18 and cross-over valve 21 are open. To perform a gravel pack operation, a service tool (not shown) is stung into the top of a sub 14 attached to the top of the PAC valve 13. The service tool has a washpipe that runs through the PAD valve 12, screen 15 and isolation valve 18. Upon completion of the gravel pack operation, the isolation valve 18 is closed by an isolation valve closure tool attached to the distal end of the washpipe as the washpipe is withdrawn up through the isolation valve 18. The cross-over valve 21 is also closed by the service tool. This isolates the first production zone 1. The service tool (not shown) is then withdrawn from the sub 14. A suitable service tool with washpipe is illustrated in U.S. Pat. No. 5,865,251, issued to Rebardi, et al, on Feb. 2, 1999, incorporated herein by reference. The second isolation string 22 is then stung into the first isolation string 11. The second isolation string comprises a isolation pipe 27 which stings all the way into the sub 14 of the first isolation string 11. The second isolation string 22 also comprises a base pipe 26 which stings into the upper packer 19 of the first isolation string 11. The second isolation string 22 also comprises a production screen 25 which is concentric about the base pipe 26. A PAD valve 23 is connected to the tops of the base pipe 26 and isolation pipe 27. The isolation pipe 27 also comprises isolation valve 28. Attached to the top of the PAD valve 23 is a sub 30 and an upper packer 29 which is connected through a section of pipe. Production tubing 5 is shown stung into the sub 30. The section of base pipe 26 between the packer 29 and the PAD valve 23 also comprises a cross-over valve 31.

Since the second isolation string 22 stings into the upper packer 19 of the first isolation string 11, it has no need for a lower packer. Further, since the first isolation string 11 has been gravel packed and isolated, the second production zone 2 may be fractured and gravel packed independent of the first production zone 1. As soon as the gravel pack procedures are terminated, the isolation valve **28*b* and the cross-over valve 31 are closed to isolate the second production zone 2. Isolation valve 28*a*** can function as a backu valve to one or more of the PAC valves and is generally closed and not used.

The gravel pack equipment is then removed from the well. Both zones remain isolated and there is no fluid loss.

To bring a zone or zones into production, production tubing 5 is then run into the well and stung into sub 30. After the production tubing 5 and surface production equipment are installed, pressure is applied down the ID of the production tubing 5. This pressure acts on all of the PAD valves and PAC valve to open the PAD valves and reconfigure the PAC valve to an unlocked, closed configuration. As the pressure is bled off, all of the PAC valve reconfigures to an open configuration. Production from the lower zone then flows through the lower PAD valve 12 and through the PAC valve 13 into the tubing ID. Production from the upper zone flows through the upper PAD valve 23 into the annular space around the production tubing 5. Additional equipment (not shown) located above packer 29 may direct flow from the two zones into two separate production strings, or allow one zone to produce up the annulus between the tubing and the casing, or commingle the two production streams.

The first isolation string 11 comprises a PAD valve 12 and a PAC valve 13. The second isolation string 22 comprises a PAD valve 23 but does not comprise a PAC valve. PAD valves enable fluid production through the annulus formed on the outside of a production tube. PAC valves enable fluid production through the interior of a production tube. These valves are discussed in greater detail below.

Referring to FIGS. 2A through 2L, an isolation system is shown comprising three separate isolation strings, wherein the uphole end is on the right and the downhold end is on the left. In this embodiment of the invention, the first production string 11 comprises a lower packer 10 and a base pipe 16 which is connected to the lower packer 10. A production screen 15 is concentric about the base pipe 16. A isolation pipe 17 extends through the interior of the base pipe 16 and has an isolation valve 18 thereon. The PAD valve 12 of the first isolation string is attached to the tops of the base pipe 16 and isolation pipe 17. In this embodiment of the invention, a sub 14 is attached to the top of the PAD valve 12. The first isolation string 11 also comprises an upper packer 19 which is connected to the top of the PAD valve 12 through a length of base pipe 16. The length of base pipe 16 has therein a cross-over valve 21.

The second isolation string 22 is stung into the first isolation string 11 and comprises a base pipe 26 with a production screen 25 therearound. Within the base pipe 26, there is a isolation pipe 27 which is stung into the sub 14 of the first isolation string 11. The isolation pipe 27 comprises isolation valve 28. Further, the base pipe 26 is stung into the packer 19 of the first isolation string 11. The second isolation string 22 comprises a PAD valve 23 which is attached to the tops of the base pipe 26 and isolation pipe 27. A PAC valve 24 is attached to the top of the PAD valve 23. Further, a sub 30 is attached to the top of the PAC valve 24. An upper packer 29 is attached to the top of the PAD valve 23 through a section of base pipe 26 which further comprises a cross-over valve 31.

The third isolation string 32 is stung into the top of the second isolation string 22. The third isolation string 32 comprises a base pipe 36 with a production screen 35 thereon. Within the base pipe 36, there is a isolation pipe 37 which has an isolation valve 38 therein. Attached to the tops of the base pipe 36 and isolation pipe 37, there is a PAD valve 33. A sub 40 is attached to the top of the PAD valve on the interior, and a packer 39 is attached to the exterior of the PAD valve 33 through a section of base pipe 36. A production tubing 5 is stung into the sub 40.

The first isolation string 11 comprises a PAD valve 12 but does not comprise a PAC valve. The second isolation string 22 comprises both a PAD valve 23 and a PAC valve 24. The third isolation string 32 only comprises a PAD valve 33 but does not comprise a PAC valve. This production system enables sequential grave pack, fracture and isolation of zones 1, 2 and 3. Also, this system enables fluid from production zones 1 and 2 to be co-mingled and produced through the interior of the production tubing, while the fluid from the third production zone is produced through the annulus around the exterior of the production tube.

The co-mingling of fluids produced by the first and second production zones is effected as follows: PAD valves 12 and 23 are opened to cause the first and second production zone fluids to flow through the productions screens 15 and 25 and into the annulus between the base pipes 16 and 26 and the isolation pipes 17 and 27. This co-mingled fluid flows up through the opened PAD valves 12 and 23 to the bottom of the PAC valve 24. PAC valve 24 is also opened to allow this co-mingled fluid of the first and second production zones 1 and 2 to flow from the annulus into the center of the base pipes 16 and 26 and the sub 30. All fluid produced by the first and second production zones through the annulus is forced into the production tube 5 interior through the open PAC valve 24.

Production from the third production zone 3 is effected by opening PAD valve 33. This allows production fluids to flow up through the annulus between the base pipe 36 and the isolation pipe 37, up through the PAD valve 33 and into the annulus between the production tube 5 and the inner bore of packer 39. Additional equipment may further redirect flow to produce through multiple production tubes or commingle zones.

Referring to FIGS. 3A through 3K, a system is shown wherein a first isolation string 11 comprises a PAD valve 12 and a PAC valve 13, wherein the uphole end is on the right and the downhold end is on the left. This first isolation string 11 is similar to that previously described with reference to FIG. 1. The second isolation string 22 comprises only a PAD valve 23 and is similar to the second isolation string described with reference to FIG. 1. The third isolation string 32 comprises only a PAD valve 33 but no PAC valve and is also similar to the second isolation string described with reference to FIG. 1. This configuration enables production from zone 1 to pass through the PAC valve into the interior of the annulus of the production tubing. The fluids from production zones two and three co-mingle and are produced through the annulus about the exterior of the production tube.

The co-mingling of fluids produced by the second and third production zones is effected as follows: Opening PAD valves 23 and 33 creates an unimpeded section of the annulus. Fluids produced through PAD valves 23 and 33 are co-mingled in the annulus.

Figure 4A:
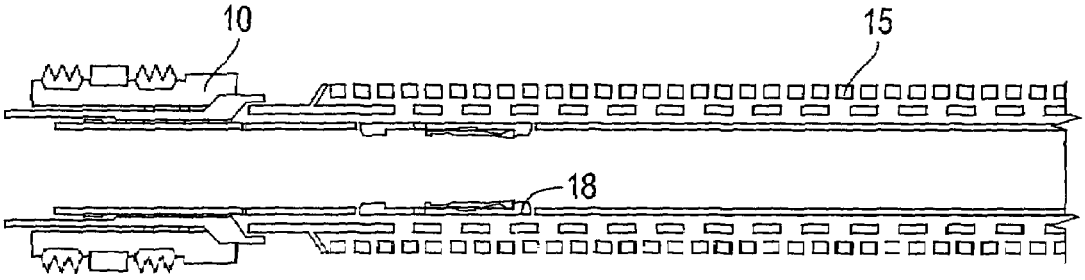
FIGS. 4A through 4N illustrate a cross-sectional, side view of first, second, third and fourth isolation strings, wherein the first and second strings co-mingle production fluids and the third and fourth strings co-mingle production fluids.
Figure 2B:
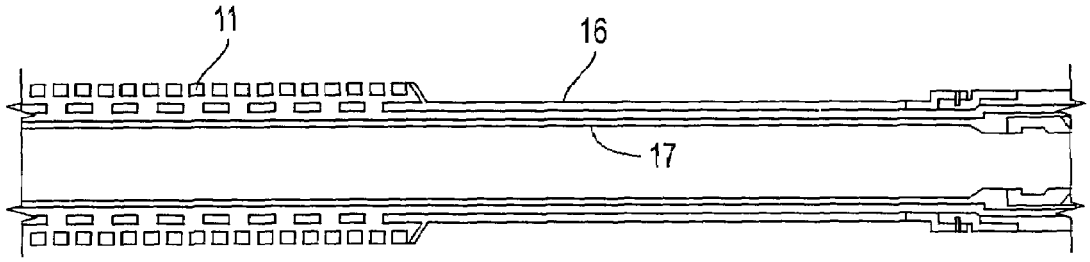
Figure 3B:
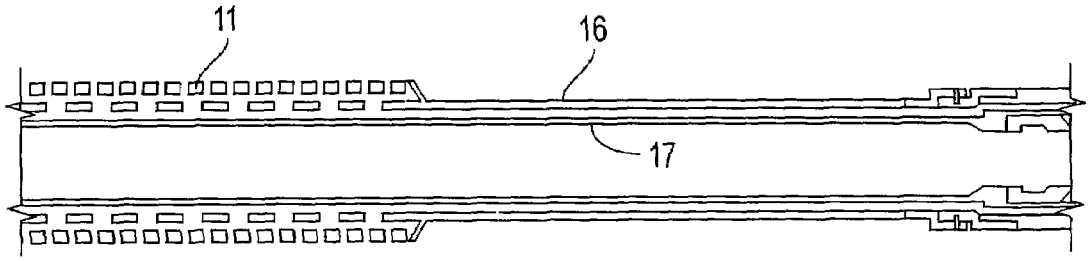
Figure 4B:
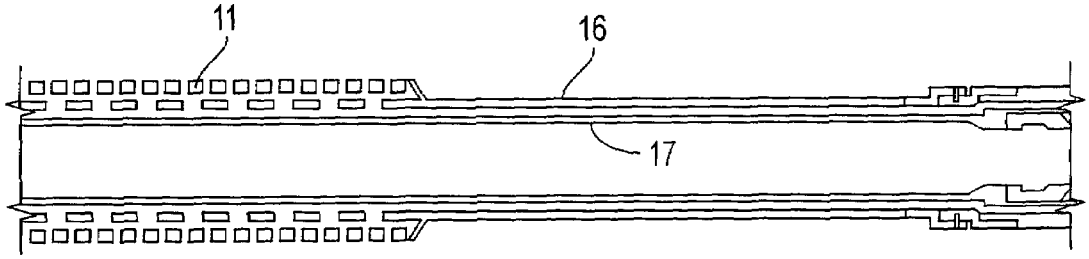
Figure 4C:
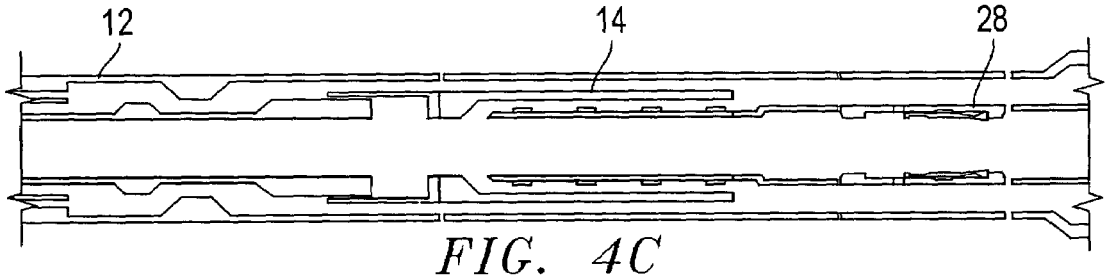
Figure 4D:
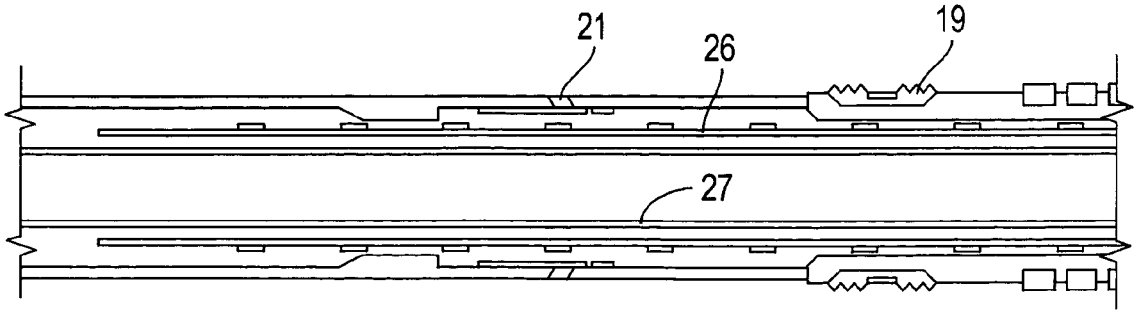
Figure 4E:
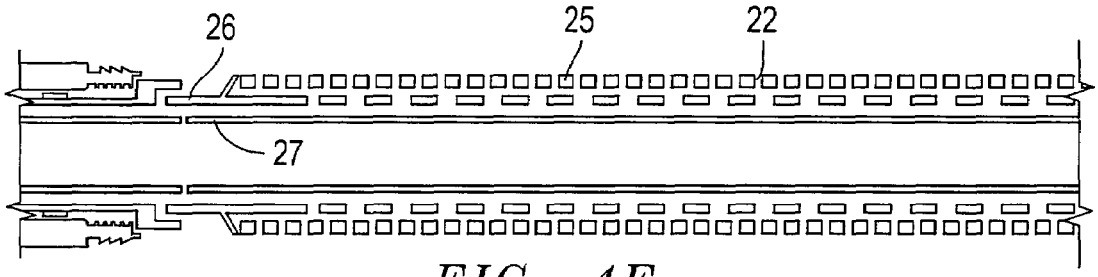
Figure 4F:
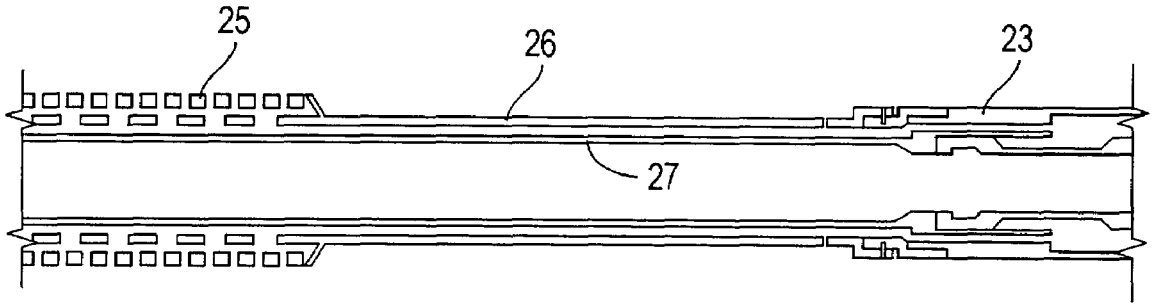
Figure 4G:
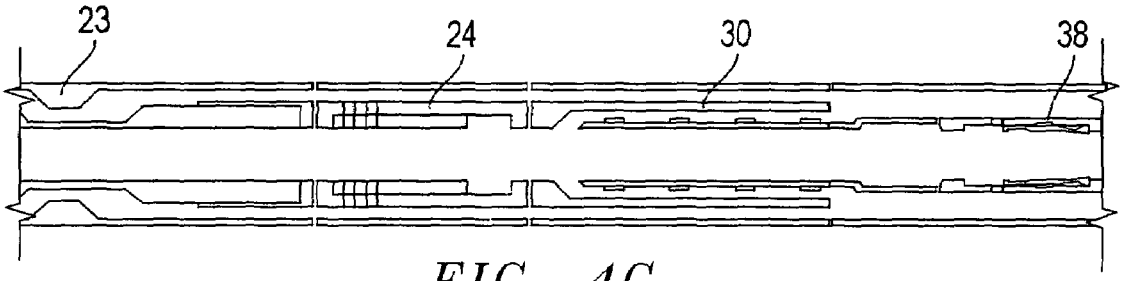
Figure 4H:
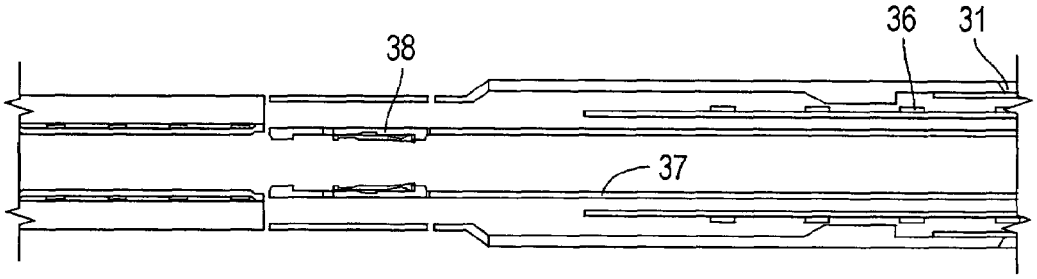
Figure 4I:
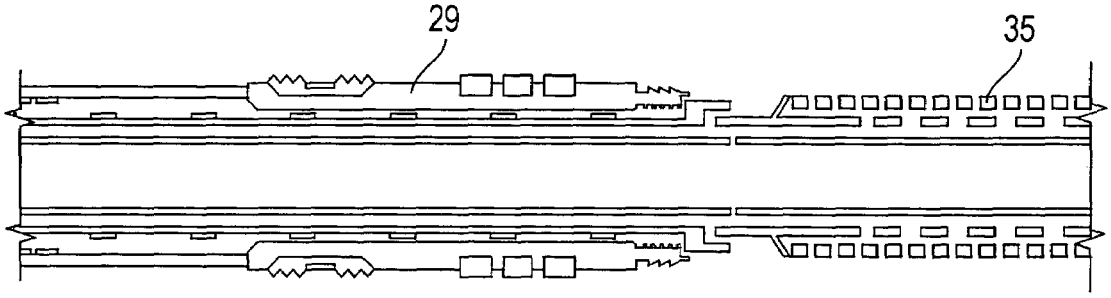
Figure 4J:
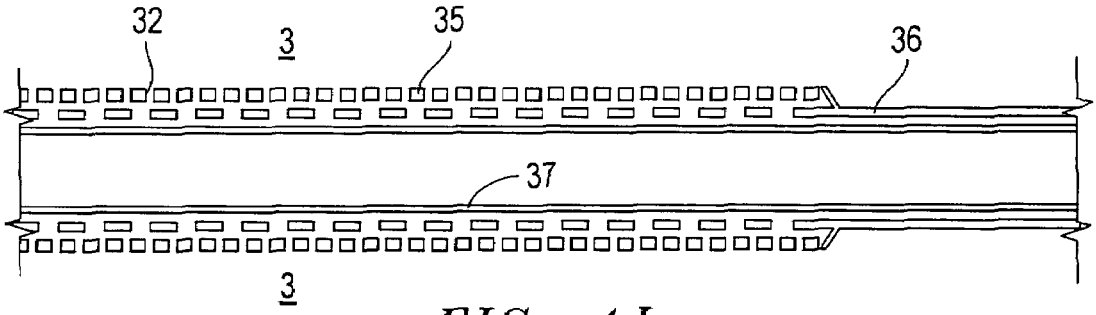
Figure 4K:
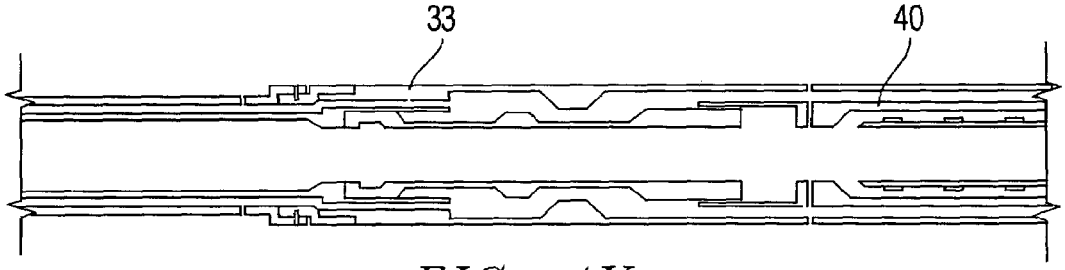
Figure 4L:
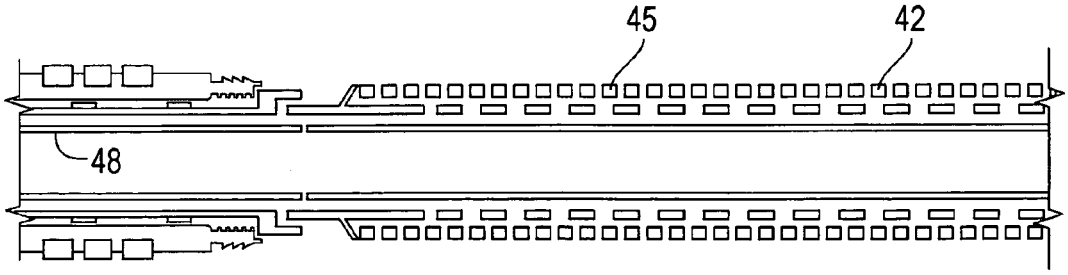
Figure 4M:
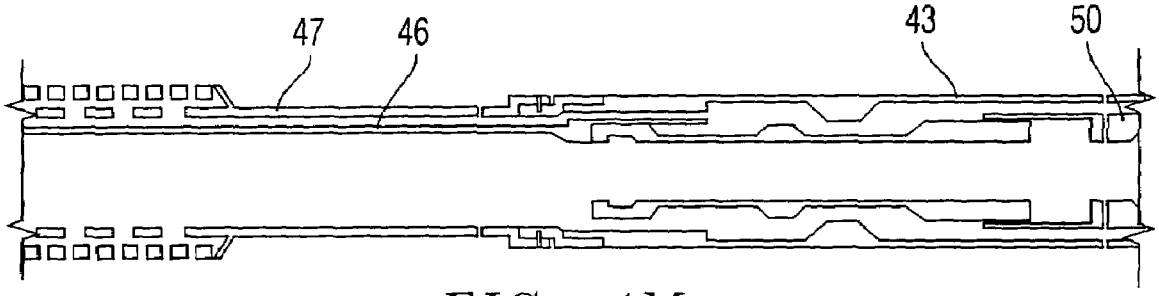
Figure 4N:
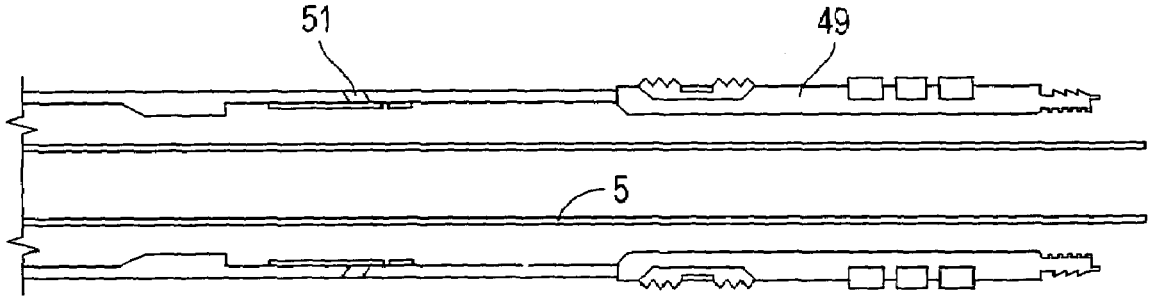
Figure 6A:
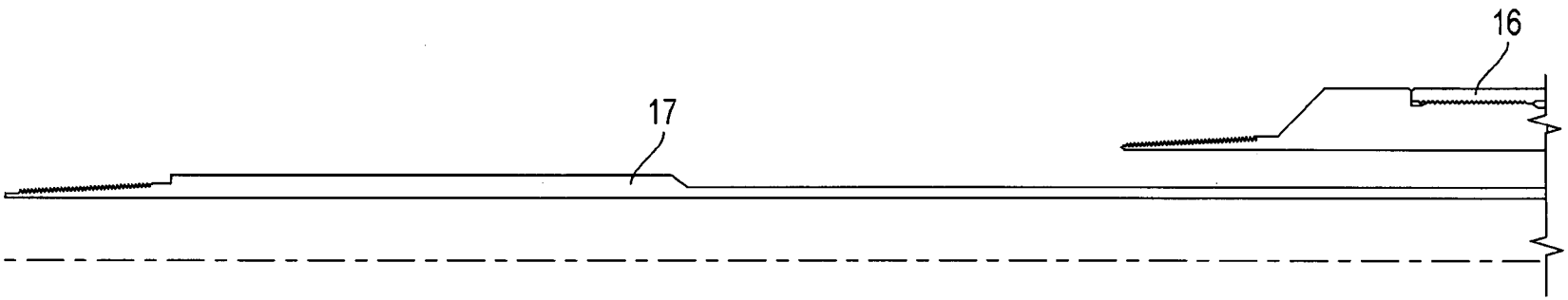
FIGS. 6A through 6E are a cross-sectional side view of the PAD valve of FIGS. 5A through 5E shown in a closed configuration so as to restrict flow through the annulus.

Referring to FIGS. 4A through 4N, a system is shown comprising four isolation strings, wherein the uphole end is on the right and the downhold end is on the left. The first isolation string 11 comprises a PAD valve 12 but no PAC valve. The second isolation string 22 comprises a PAD valve 23 and a PAC valve 24. The third isolation string 32 comprises a PAD valve 33 but does not comprise a PAC valve. Similarly the fourth isolation string 42 comprises a PAD valve 43 but does not comprise a PAC valve. In this particular configuration, production fluids from zones one and two are co-mingled for production through the PAC valve into the interior of the production tube 5. The fluids from production zones three and four are co-mingled for production through the annulus formed on the outside of the production tube 5.

In this embodiment, the first isolation string 11 is similar to the first isolation string shown in FIG. 2. The second isolation string 22 is also similar to the second isolation string shown in FIG. 2. The third isolation string is also similar to the third isolation string shown in FIG. 2. However, rather than having a production tubing 5 stung into the top of the third isolation string, the embodiment shown in FIG. 4, comprises a fourth isolation string 42. The fourth isolation string comprises a base pipe 46 with a production screen 45 therearound. On the inside of the base pipe 46, there is a isolation pipe 47 which has an isolation valve 48. Attached to the tops of the base pipe 46 and the isolation pipe 47, there is a PAD valve 43. To the interior of the top of the PAD valve 43, there is attached a sub 50. To the exterior of the PAD valve 43, there is attached through a section of base pipe 46, an upper packer 49, wherein the section of base pipe 46 comprises a cross-over valve 51. A production tubing 5 is stung into the sub 50.

Referring to FIGS. 5A through 5F and 6A through 6E, detailed drawings of a PAD valve are shown, wherein the uphole end is on the right and the downhold end is on the left. In FIG. 5, the valve is shown in an open position and in FIG. 6, the valve is shown in a closed position. In the open position, the valve enables fluid communication through the annulus between the interior and exterior tubes of the isolation string. Essentially, these interior and exterior tubes are sections of the base pipe 16 and the isolation pipe 17. The PAD valve comprises a shoulder 52 that juts into the annulus between two sealing lands 58A and 58B. The shoulder 52 is separated from each of the sealing lands 58A and 58B by relatively larger diameter troughs 60. The internal diameter of the shoulder 52 and the sealing land 58B are about the same. However, the internal diameter of the sealing land 58A is relatively greater compared to the internal diameter of the shoulder 52 and sealing land 58B. A moveable joint 54 is internally concentric to the shoulder 52 and the sealing lands 58A and 58B. The moveable joint 54 also has seals 56 which contact sealing lands 58A and 58B and the shoulder 52. The movable joint 54 has a spanning section 62 and a closure section 64, wherein the outside diameter of the spanning section 62 is less than the outside diameter of the closure section 64. The moveable joint 54 also has a pressure area 59.

Figure 5A:
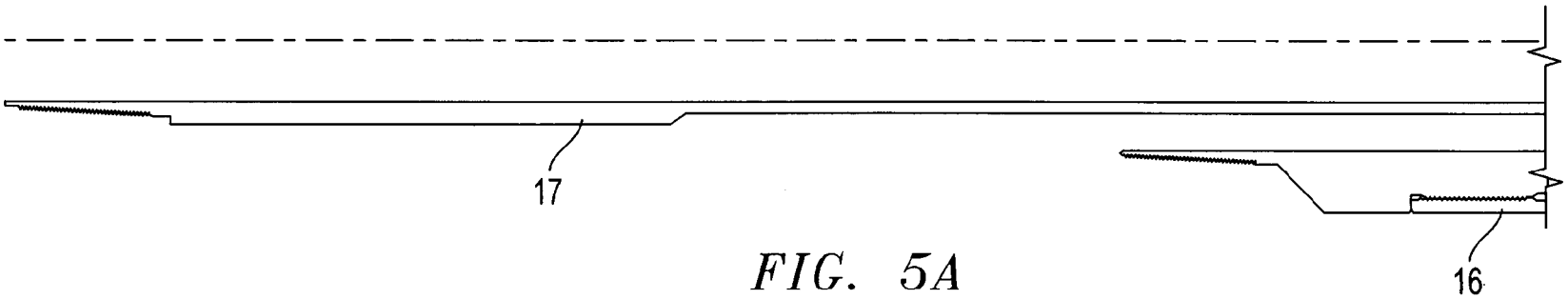
FIGS. 5A through 5E are a cross-sectional side view of a pressure actuated device (PAD) valve shown in an open configuration.
Figure 5F:
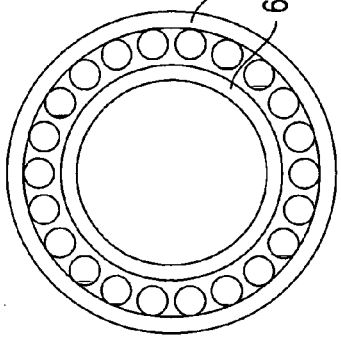
FIG. 5F is a cross-sectional end view of a portion of the PAD valve of FIG. 5B.
Figure 5B:
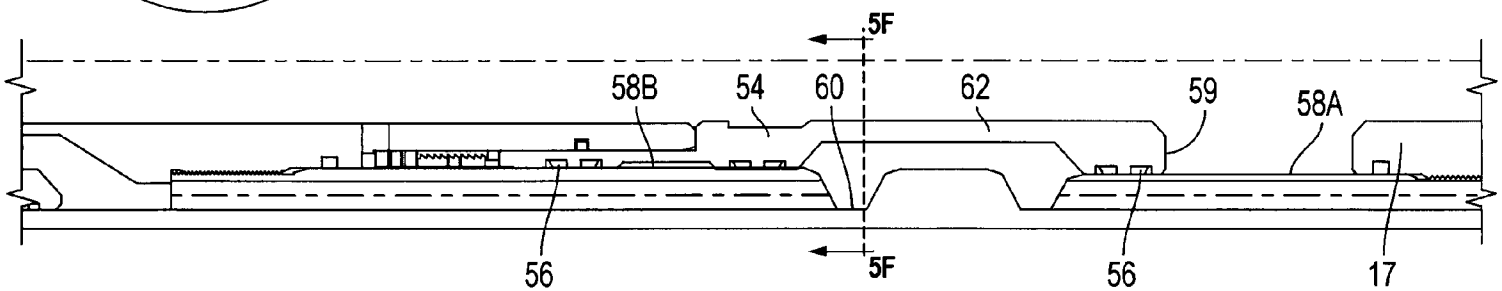
Figure 6B:
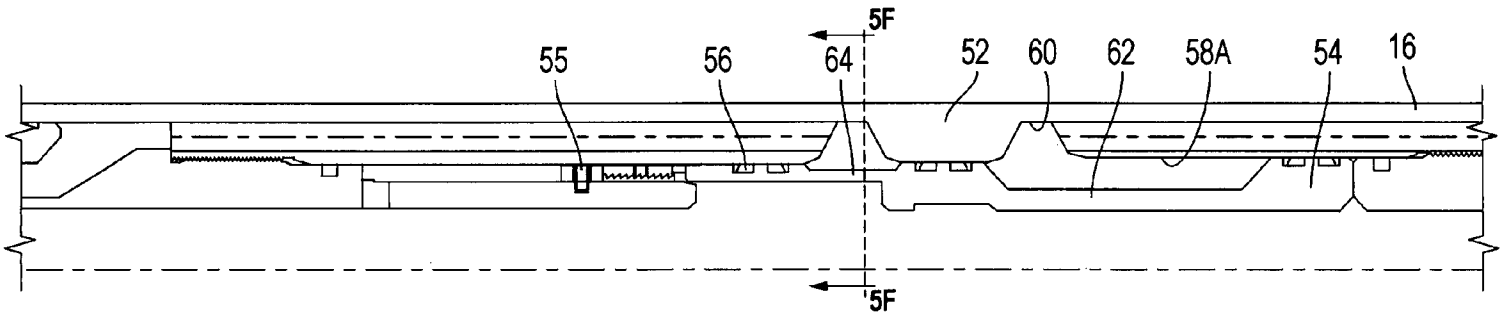
Figure 5C:
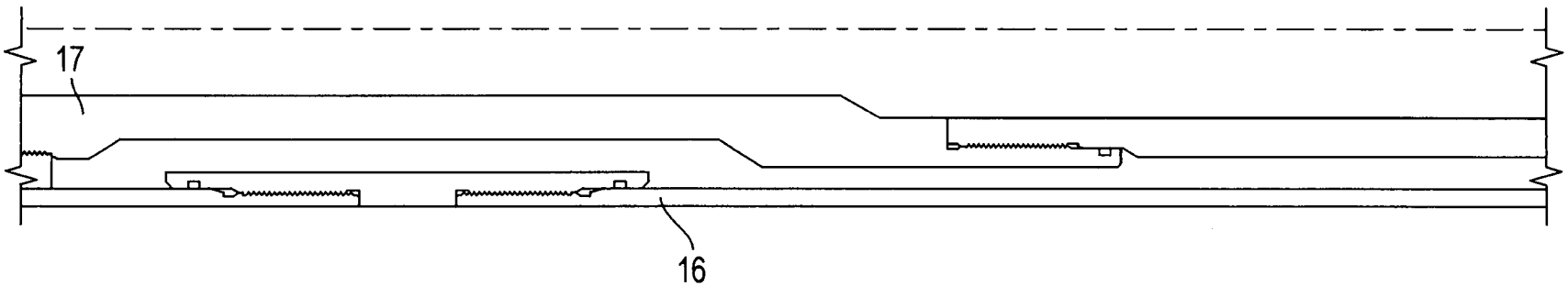
Figure 6C:
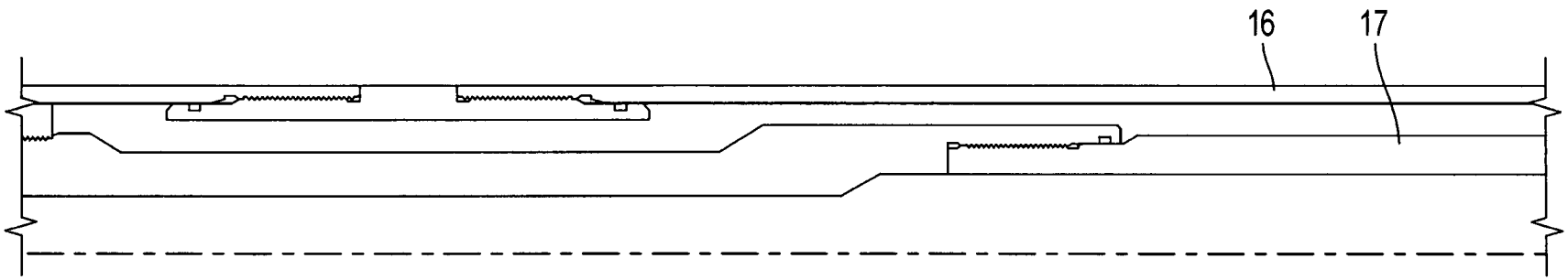
Figure 5D:
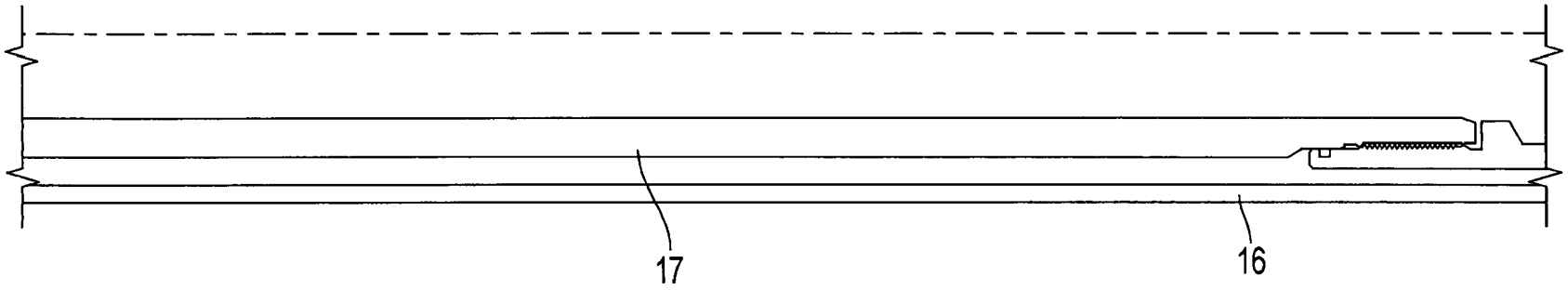
Figure 6D:
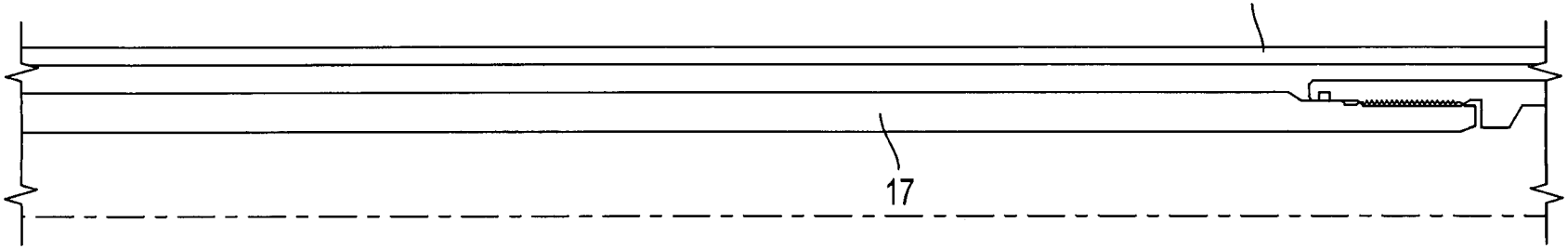
Figure 5E:
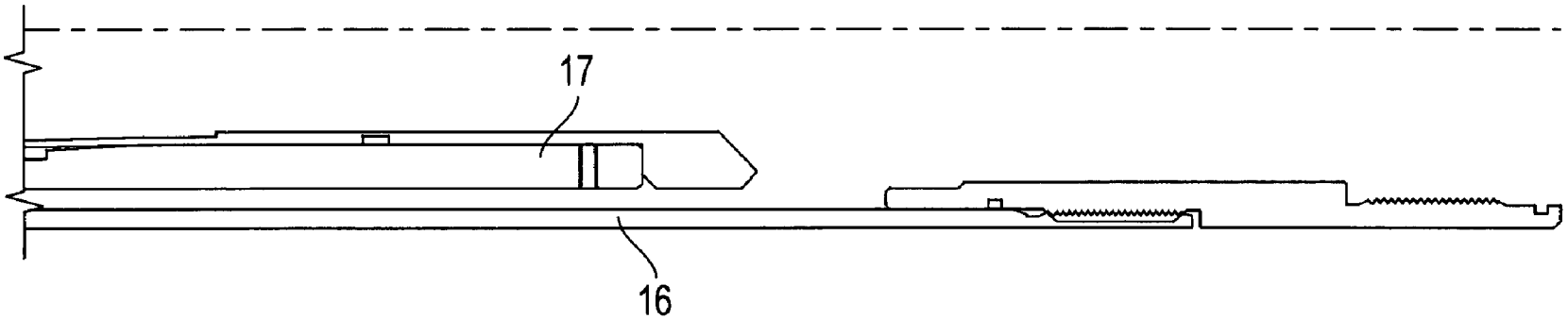
Figure 6E:
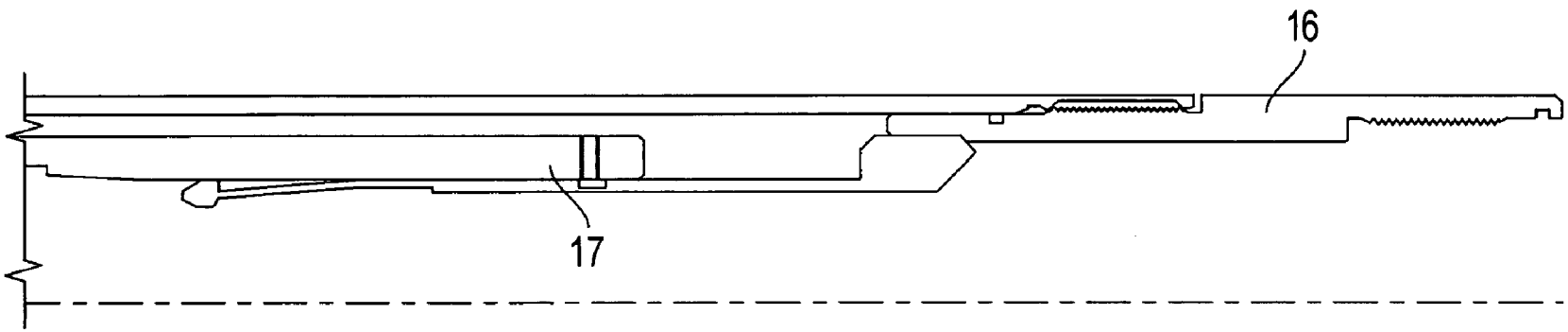
Figure 7A:
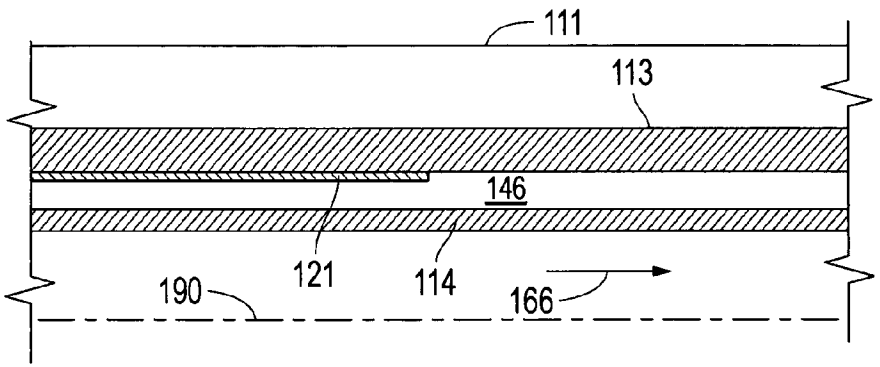
FIGS. 7A through 7D are a side, partial cross-sectional, diagrammatic view of a pressure actuated circulating (PAC) valve assembly in a locked-closed configuration. It will be understood that the cross-sectional view of the other half of the production tubing assembly is a mirror image taken along the longitudinal axis.
Figure 8A:
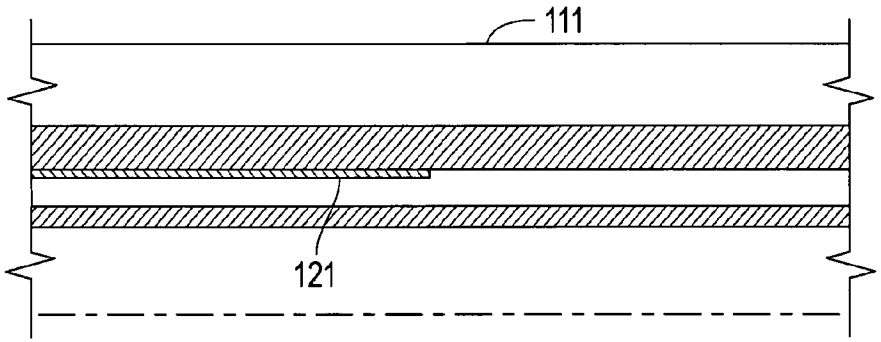
FIGS. 8A through 8D illustrate the isolation system of FIG. 7 in an unlocked-closed configuration.
Figure 7B:
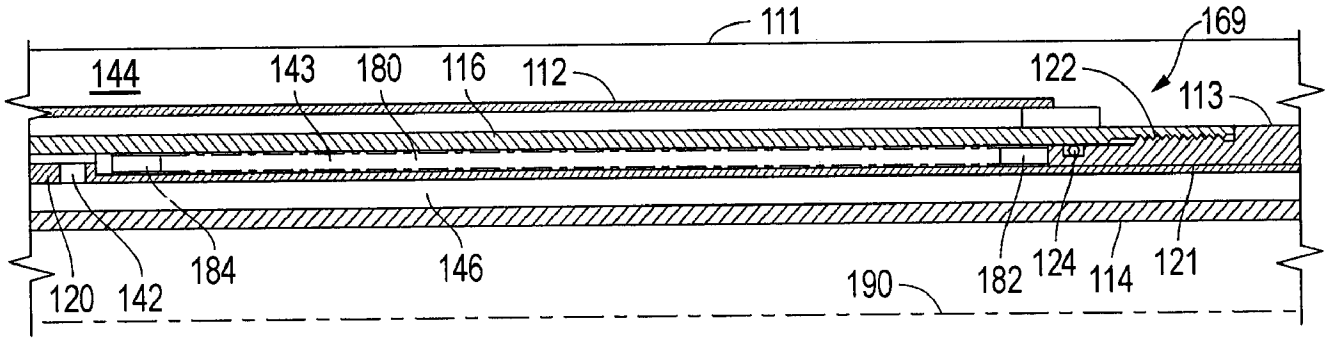
Figure 8B:
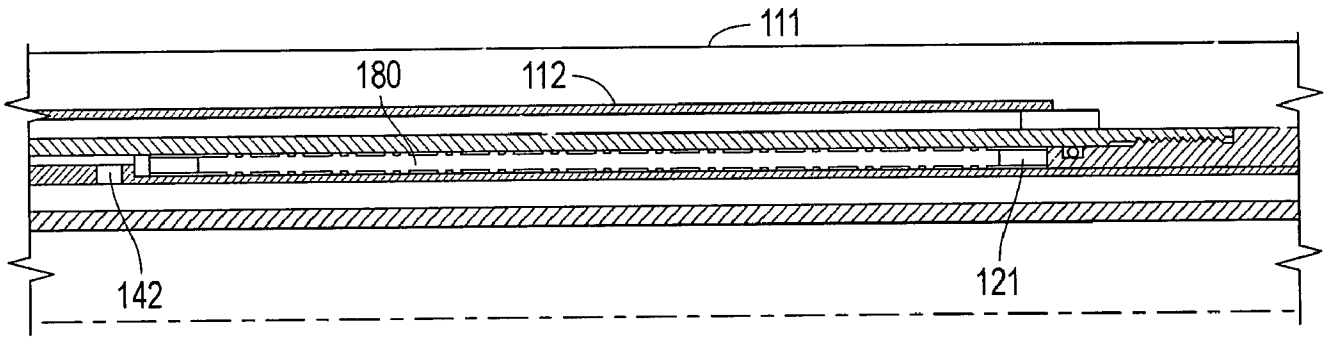
Figure 7C:
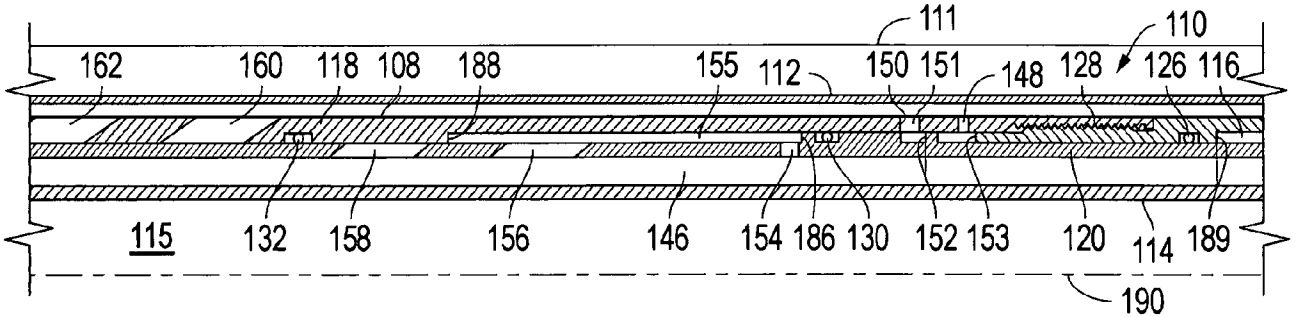
Figure 8C:
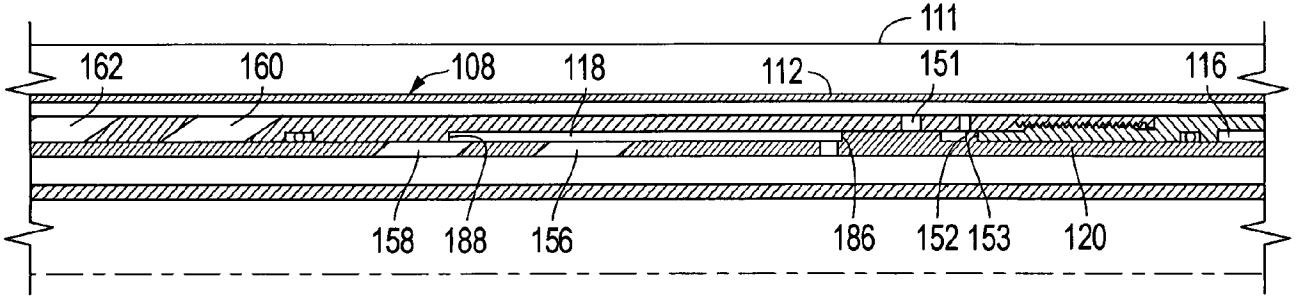

The valve is in a closed position when the valve is inserted in the well. The PAD valve is held in the closed position by a shear pin 55. A certain change in differential fluid pressure between the annulus around the spanning section 62 and the ID of the moveable joint 54 causes the moveable joint 54 to shift. Because the inside diameter of the sealing land 58A is greater than the inside diameter of the shoulder 52, a force exerted on the pressure area 59 is greater than the sum of forces acting in the opposite direction on the moveable joint 54. The differential fluid pressure acting on the pressure area 59 slides the moveable joint 54 to eliminate the contact between the moveable joint 54 and the shoulder 52. The differential pressure further acts on the moveable joint 54 to slide the moveable joint 54 to a position where the spanning section 62 is immediately adjacent the shoulder 52. Since the outside diameter of the spanning section 62 is less than the inside diameter of the shoulder 52, fluid flows freely around the shoulder 52 and through the PAD valve, as shown in FIG. 5B.

As shown in FIG. 6, in the closed position, the PAD valve restricts flow through the annulus. Here, the PAD valve has contact between the shoulder 52 and the moveable joint 54, forming a seal to block fluid flow through the annulus at the PAD valve.

Referring to FIGS. 7A through 7D, there is shown a production tubing assembly 110 according to the present invention, wherein the uphole end is on the right and the downhold end is on the left. The production tubing assembly 110 is mated in a conventional manner and will only be briefly described herein. Assembly 110 includes production pipe 140 that extends to the surface and a production screen assembly 112 with PAC valve assembly 108 controlling fluid flow through the screen assembly. In a preferred embodiment production screen assembly 112 is mounted on the exterior of PAC valve assembly 108. PAC valve assembly 108 is interconnected with production tubing 140 at the uphole end by threaded connection 138 and seal 136. Similarly on the downhole end 169, PAC valve assembly 108 is interconnected with production tubing extension 113 by threaded connection 122 and seal 124. In the views shown, the production tubing assembly 110 is disposed in well casing 111 and has inner tubing 114, with an internal bore 115, extending through the inner bore 146 of the assembly.

The production tubing assembly 110 illustrates a single preferred embodiment of the invention. However, it is contemplated that the PAC valve assembly according to the present invention may have uses other than at a production zone and may be mated in combination with a wide variety of elements as understood by a person skilled in the art. Further, while only a single isolation valve assembly is shown, it is contemplated that a plurality of such valves may be placed within the production screen depending on the length of the producing formation and the amount of redundancy desired. Moreover, although an isolation screen is disclosed in the preferred embodiment, it is contemplated that the screen may include any of a variety of external or internal filtering mechanisms including but not limited to screens, sintered filters, and slotted liners. Alternatively, the isolation valve assembly may be placed without any filtering mechanisms.

Referring now more particularly to PAC valve assembly 108, there is shown outer sleeve upper portion 118 joined with an outer sleeve lower portion 116 by threaded connection 128. Outer sleeve upper portion 118 includes two relatively large production openings 160 and 162 for the flow of fluid from the formation when the valve is in an open configuration. For the purpose of clarity in the drawings, these openings have been shown at a 45° inclination. Outer sleeve upper portion 118 also includes through bores 148 and 150. Disposed within bore 150 is shear pin 151, described further below. The outer sleeve assembly has an outer surface and an internal surface. On the internal surface, the outer sleeve upper portion 118 defines a shoulder 188 (FIG. 7C) and an area of reduced wall thickness extending to threaded connection 128 resulting in an increased internal diameter between shoulder 188 and connection 128. Outer sleeve lower portion 116 further defines internal shoulder 189 and an area of reduced internal wall thickness extending between shoulder 189 and threaded connection 122. Adjacent threaded connection 138, outer sleeve portion 118 defines an annular groove 176 adapted to receive a locking ring 168.

Disposed within the outer sleeves is inner sleeve 120. Inner sleeve 120 includes production openings 156 and 158 which are sized and spaced to correspond to production openings 160 and 162, respectively, in the outer sleeve when the valve is in an open configuration. Inner sleeve 120 further includes relief bores 154 and 142. On the outer surface of inner sleeve there is defined a projection defining shoulder 186 and a further projection 152. Further inner sleeve 120 includes a portion 121 having a reduced external wall thickness. Portion 121 extends down hole and slidably engages production pipe extension 113. Adjacent uphole end 167, inner sleeve 120 includes an area of reduced external diameter 174 defining a shoulder 172.

In the assembled condition shown in FIGS. 7A through 7D, inner sleeve 120 is disposed within outer sleeves 116 and 118, and sealed thereto at various locations. Specifically, on either side of production openings 160 and 162, seals 132 and 134 seal the inner and outer sleeves. Similarly, on either side of shear pin 151, seals 126 and 130 seal the inner sleeve and outer sleeve. The outer sleeves and inner sleeve combine to form a first chamber 155 defined by shoulder 188 of outer sleeve 118 and by shoulder 186 of the inner sleeve. A second chamber 143 is defined by outer sleeve 116 and inner sleeve 120. A spring member 180 is disposed within second chamber 143 and engages production tubing 113 at end 182 and inner sleeve 120 at end 184. A lock ring 168 is disposed within recess 176 in outer sleeve 118 and retained in the recess by engagement with the exterior of inner sleeve 120. Lock ring 168 includes a shoulder 170 that extends into the interior of the assembly and engages a corresponding external shoulder 172 on inner sleeve 120 to prevent inner sleeve 120 from being advanced in the direction of arrow 164 beyond lock ring 168 while it is retained in groove 176.

The PAC valve assembly of the present invention has three configurations as shown in FIGS. 7 through 9. In a first configuration shown in FIG. 7, the production openings 156 and 158 in inner sleeve 120 are axially spaced from production openings 160 and 162 along longitudinal axis 190. Thus, PAC valve assembly 108 is closed and restricts flow through screen 112 into the interior of the production tubing. The inner sleeve is locked in the closed configuration by a combination of lock ring 168 which prevents movement of inner sleeve 120 up hole in the direction of arrow 164 to the open configuration. Movement down hole is prevented by shear pin 151 extending through bore 150 in the outer sleeve and engaging an annular recess in the inner sleeve. Therefore, in this position the inner sleeve is in a locked closed configuration.

In a second configuration shown in FIGS. 8A through 8D, shear pin 151 has been severed and inner sleeve 120 has been axially displaced down hole in relation to the outer sleeve in the direction of arrow 166 until external shoulder 152 on the inner sleeve engages end 153 of outer sleeve 116, wherein the uphole end is on the right and the downhold end is on the left. The production openings of the inner and outer sleeves continue to be axial displaced to prevent fluid flow therethrough. With the inner sleeve axial displaced down hole, lock ring 168 is disposed adjacent reduced outer diameter portion 174 of inner sleeve 120 such that the lock ring may contract to a reduced diameter configuration. In the reduced diameter configuration shown in FIG. 8, lock ring 168 may pass over recess 176 in the outer sleeve without engagement therewith. Therefore, in this configuration, inner sleeve is in an unlocked position.

In a third configuration shown in FIGS. 9A through 9D, inner sleeve 120 is axially displaced along longitudinal axis 190 in the direction of arrow 164 until production openings 156 and 158 of the inner sleeve are in substantial alignment with production openings 160 and 162, respectively, of the outer sleeve, wherein the uphole end is on the right and the downhold end is on the left. Axial displacement is stopped by the engagement of external shoulder 186 with internal shoulder 188. In this configuration, PAC valve assembly 108 is in an open position.

In the operation of a preferred embodiment, at least one PAC valve according to the present invention is mated with production screen 112 and, production tubing 113 and 140, to form production assembly 110. The production assembly according to FIG. 7 with the PAC valve in the locked-closed configuration, is then inserted into casing 111 until it is positioned adjacent a production zone (not shown). When access to the production zone is desired, a predetermined pressure differential between the casing annulus 144 and internal annulus 146 is established to shift inner sleeve 120 to the unlocked-closed configuration shown in FIG. 8. It will be understood that the amount of pressure differential required to shift inner sleeve 120 is a function of the force of spring 180, the resistance to movement between the inner and outer sleeves, and the shear point of shear pin 151. Thus, once the spring force and resistance to movement have been overcome, the shear pin determines when the valve will shift. Therefore, the shifting pressure of the valve may be set at the surface by inserting shear pins having different strengths.

A pressure differential between the inside and outside of the valve results in a greater amount of pressure being applied on external shoulder 186 of the inner sleeve than is applied on projection 152 by the pressure on the outside of the valve. Thus, the internal pressure acts against shoulder 186 of to urge inner sleeve 120 in the direction of arrow 166 to sever shear pin 151 and move projection 152 into contact with end 153 of outer sleeve 116. It will be understood that relief bore 148 allows fluid to escape the chamber formed between projection 152 and end 153 as it contracts. In a similar fashion, relief bore 142 allows fluid to escape chamber 143 as it contracts during the shifting operation. After inner sleeve 120 has been shifted downhole, lock ring 168 may contract into the reduced external diameter of inner sleeve positioned adjacent the lock ring. Often, the pressure differential will be maintained for a short period of time at a pressure greater than that expected to cause the down hole shift to ensure that the shift has occurred. This is particularly important where more than one valve according to the present invention is used since once one valve has shifted to an open configuration in a subsequent step, a substantial pressure differential is difficult to establish.

The pressure differential is removed, thereby decreasing the force acting on shoulder 186 tending to move inner sleeve 120 down hole. Once this force is reduced or eliminated, spring 180 urges inner sleeve 120 into the open configuration shown in FIG. 9. Lock ring 168 is in a contracted state and no longer engages recess 176 such the ring now slides along the inner surface of the outer sleeve. In a preferred embodiment spring 180 has approximately 300 pounds of force in the compressed state in FIG. 8. However, varying amounts of force may be required for different valve configurations. Moreover, alternative sources other than a spring may be used to supply the force for opening. As inner sleeve 120 moves to the open configuration, relief bore 154 allows fluid to escape chamber 155 as it is contracted, while relief bores 148 and 142 allow fluid to enter the connected chambers as they expand.

Figure 9A:
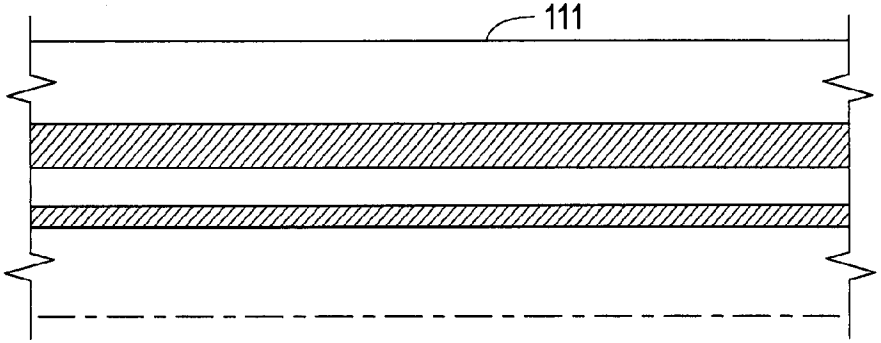
FIGS. 9A through 9D illustrate the isolation system of FIG. 8 in an open configuration.
Figure 9B:
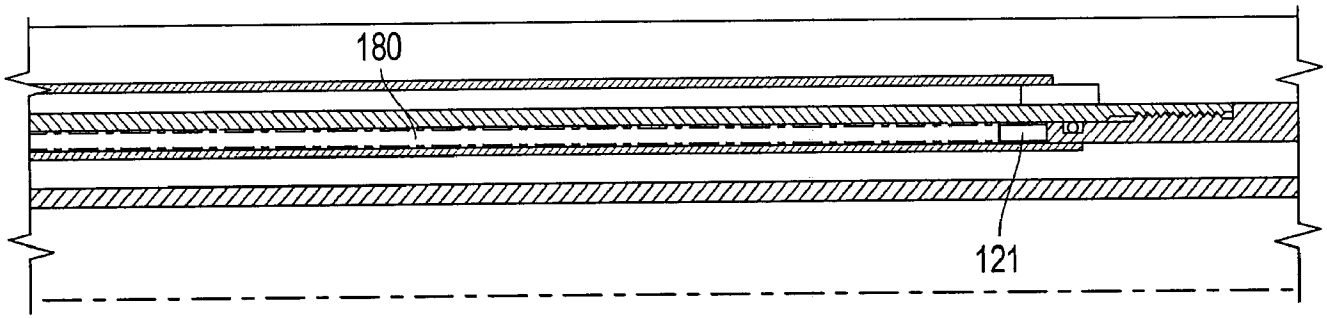
Figure 9C:
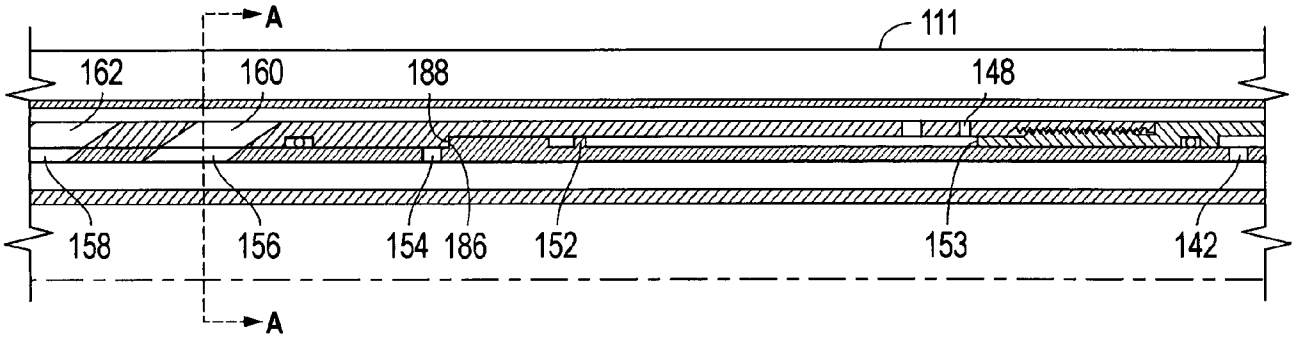
Figure 7D:
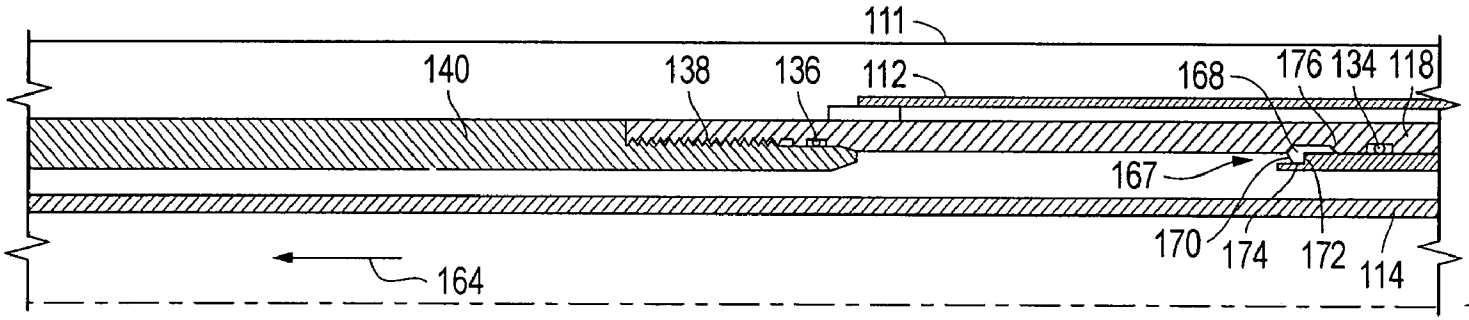
Figure 8D:
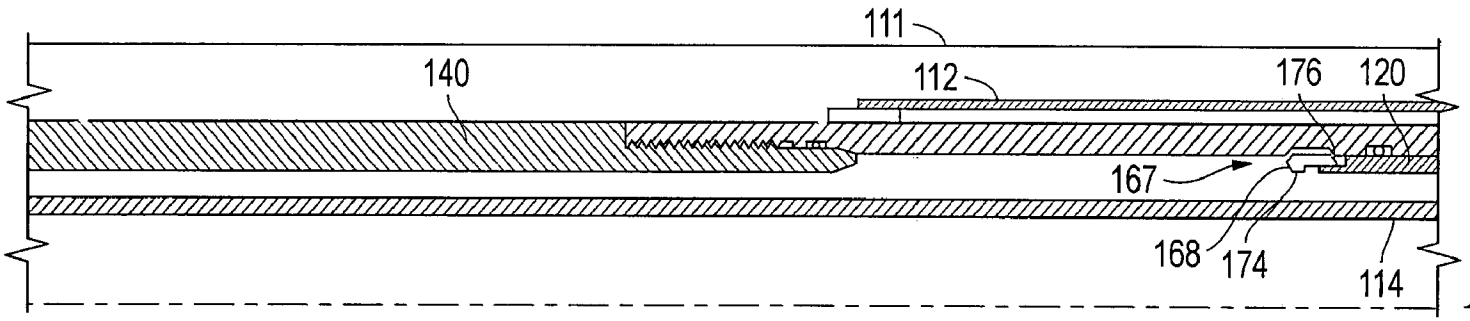
Figure 9D:
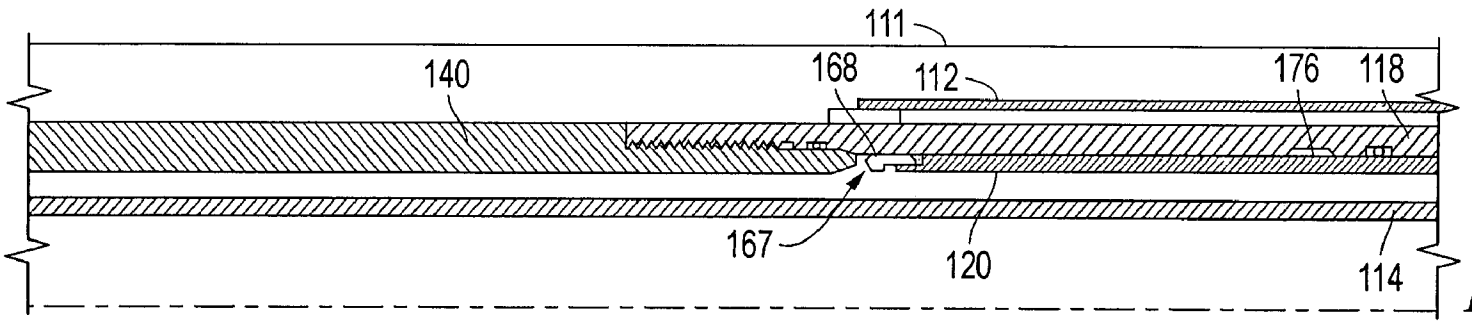
Figure 10:
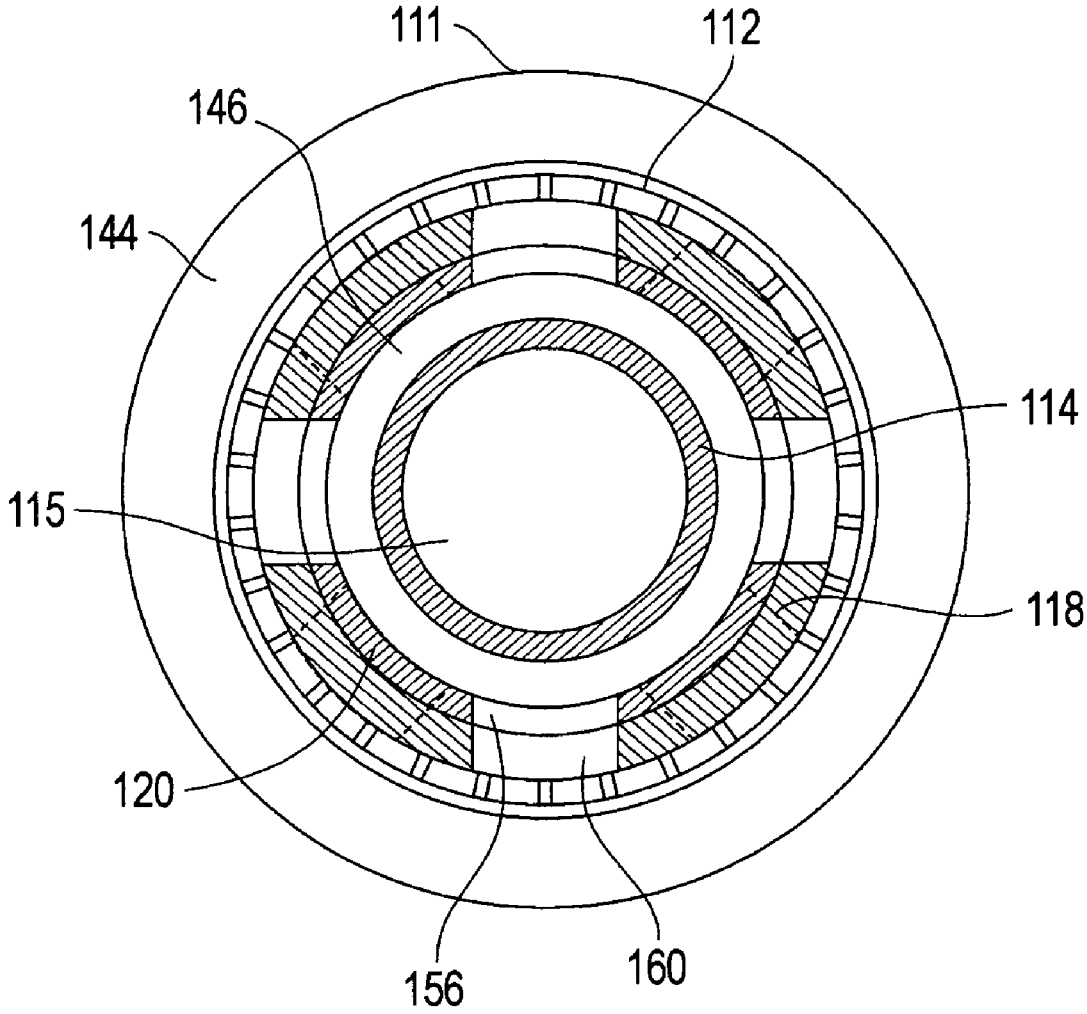
FIG. 10 is a cross-sectional, diagrammatic view taken along line A—A of FIG. 9C showing the full assembly.
Figure 11A:
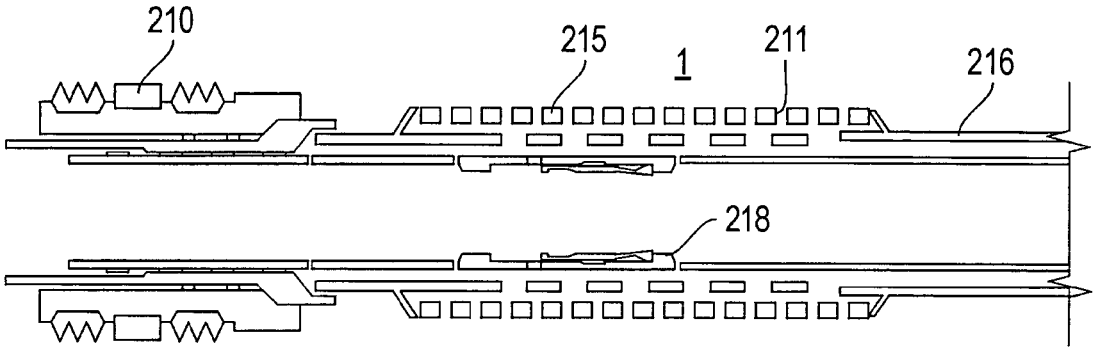
FIGS. 11A through 11D illustrate a cross-sectional side view of a first isolation string.
Figure 12A:
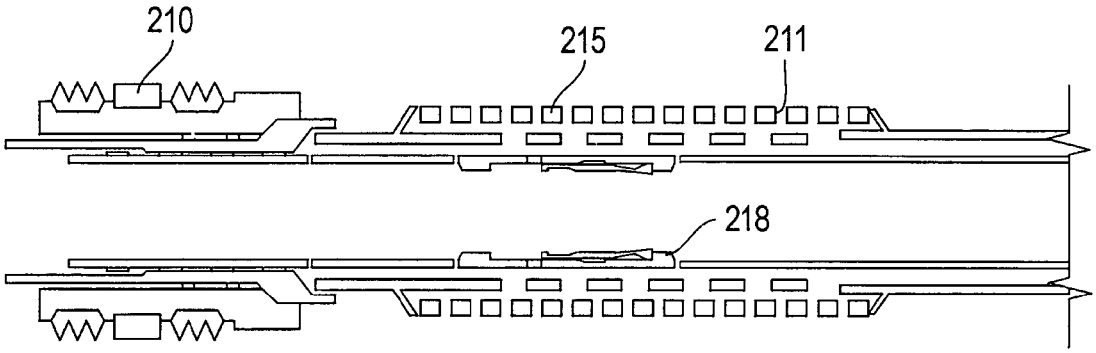
FIGS. 12A through 12I illustrate a cross-sectional side view of a second isolation string stung into the first isolation string shown in FIG. 11.
Figure 11B:
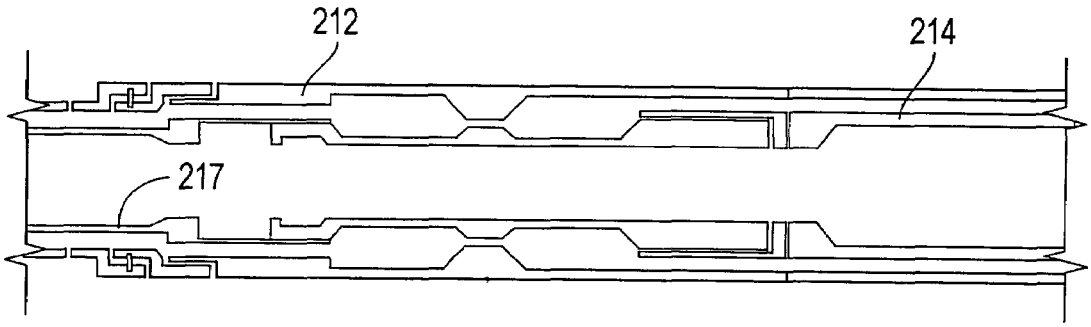
Figure 12B:
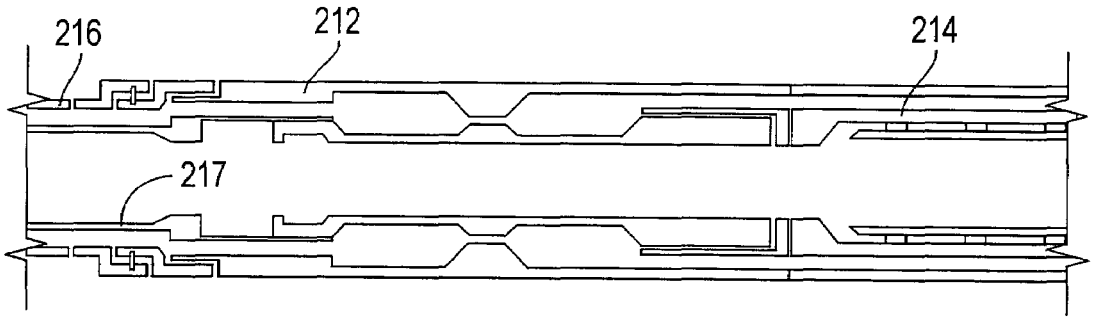
Figure 11C:
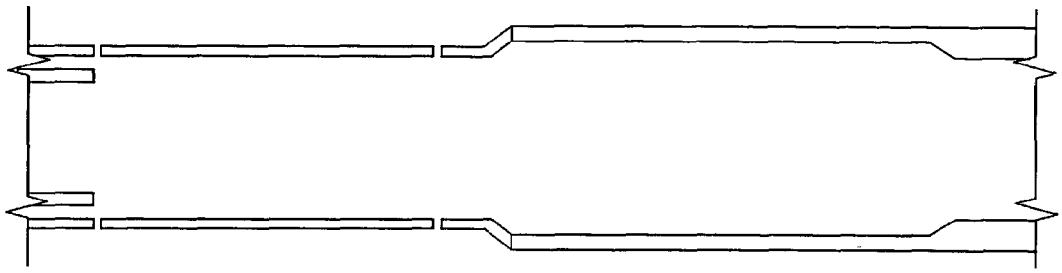
Figure 12C:
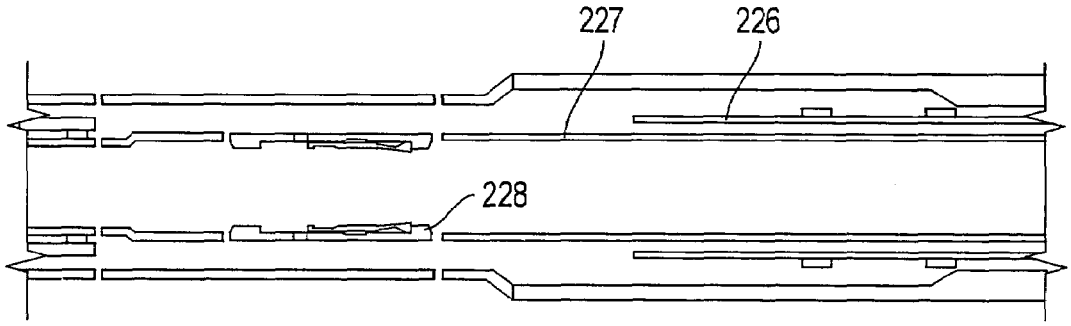
Figure 11D:
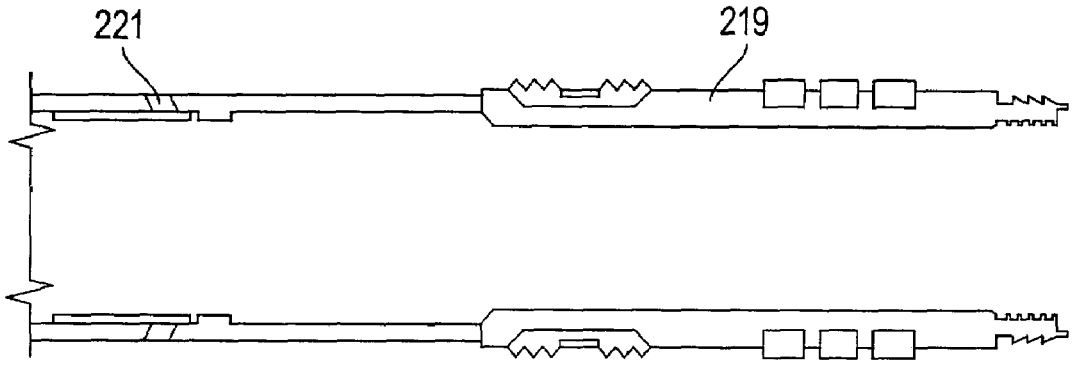
Figure 12D:
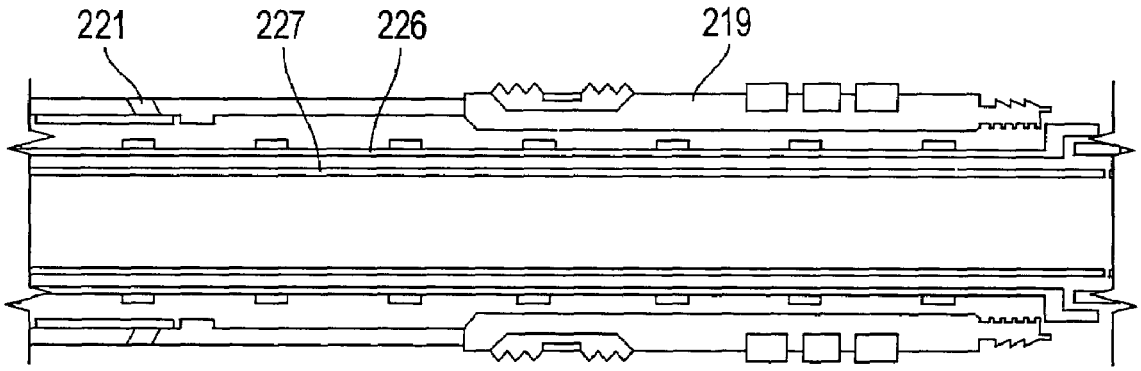
Figure 12E:
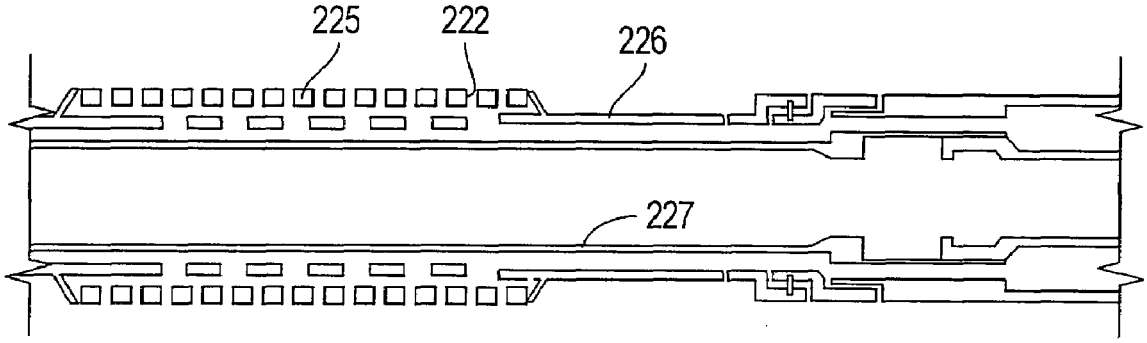
Figure 12F:
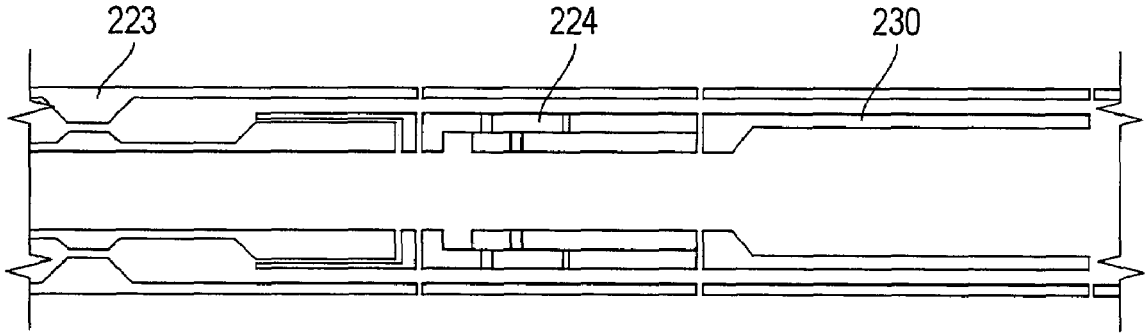
Figure 12G:
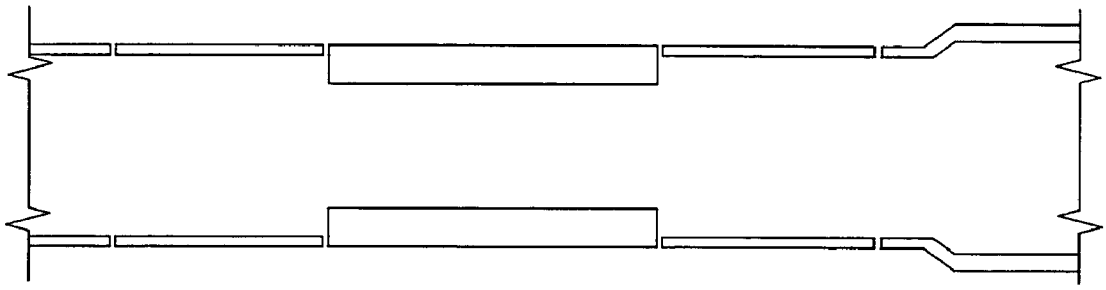
Figure 12H:
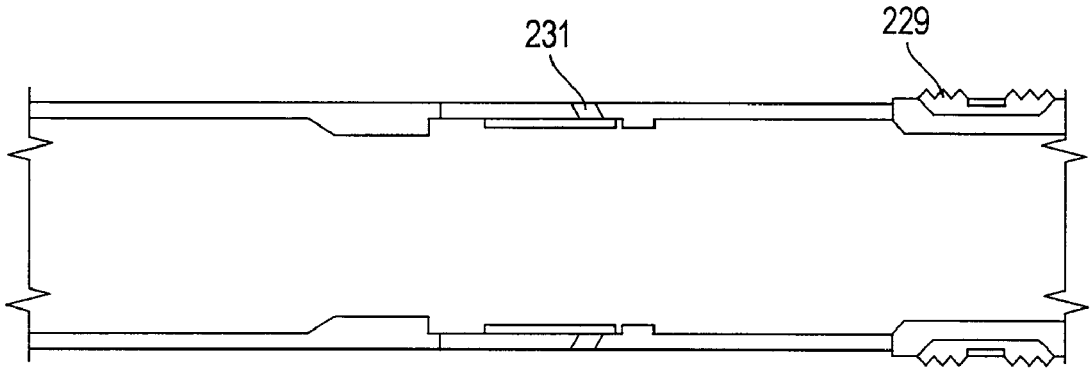
Figure 12I:
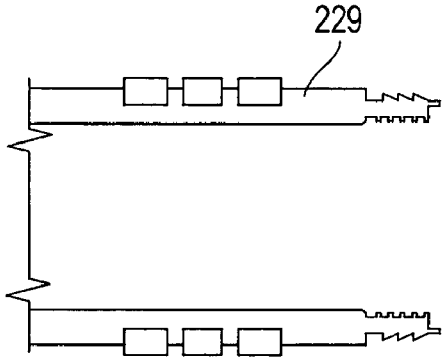
Figure 13A:
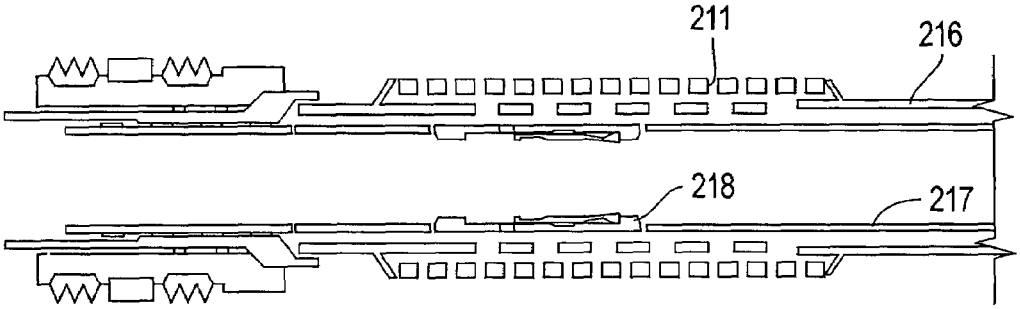
FIGS. 13A through 13L illustrate a cross-sectional side view of a third isolation string stung into the second isolation string shown in FIG. 12, wherein the first isolation string is also shown.
Figure 14A:
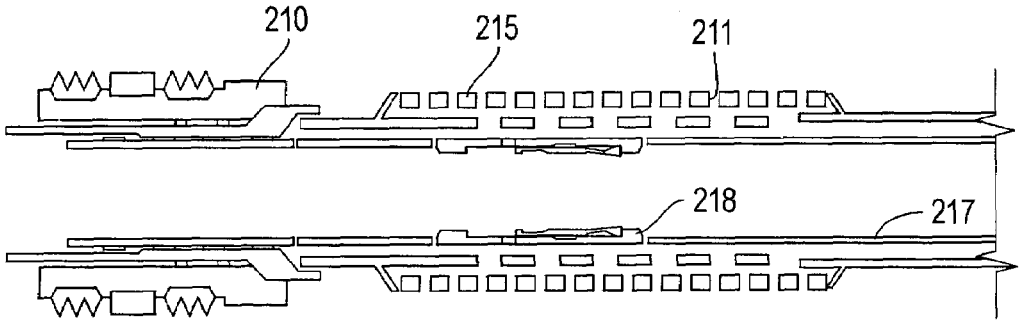
FIGS. 14A through 14L illustrate a cross-sectional side view of the first, second and third isolation strings shown in FIGS. 11 through 13, wherein a production string is stung into the third isolation string.
Figure 13B:
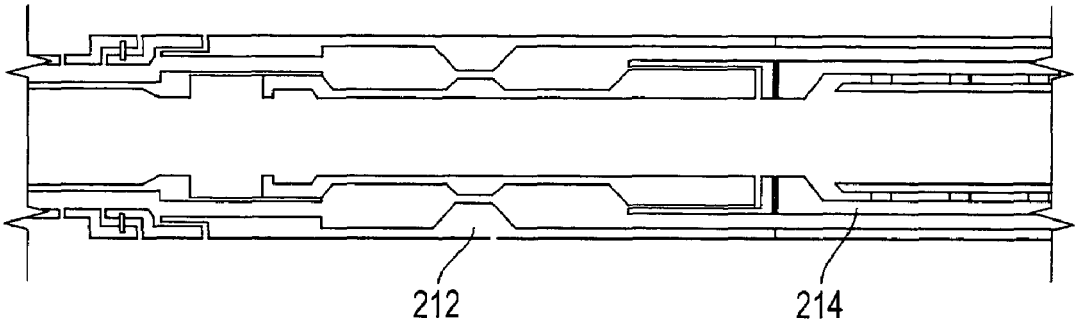
Figure 14B:
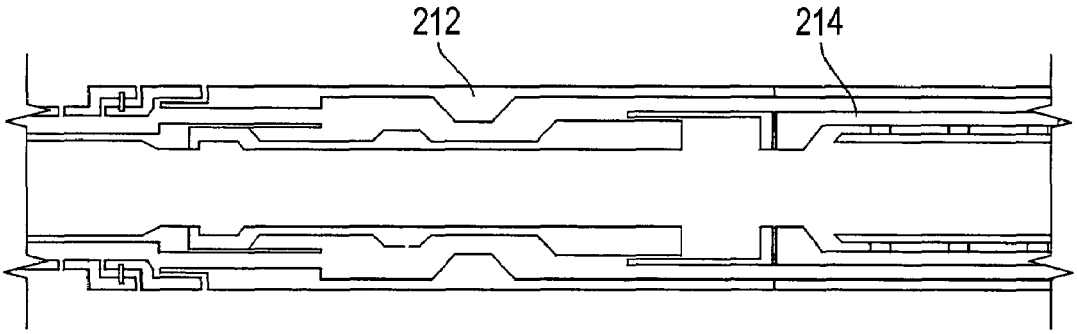
Figure 13C:
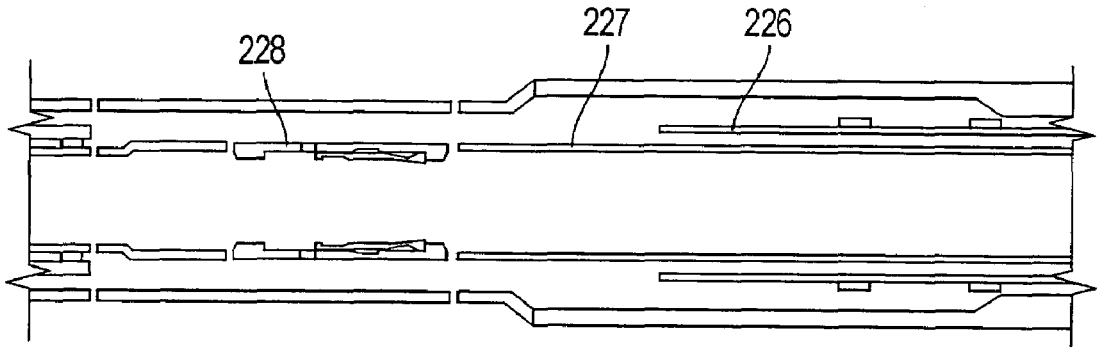
Figure 14C:
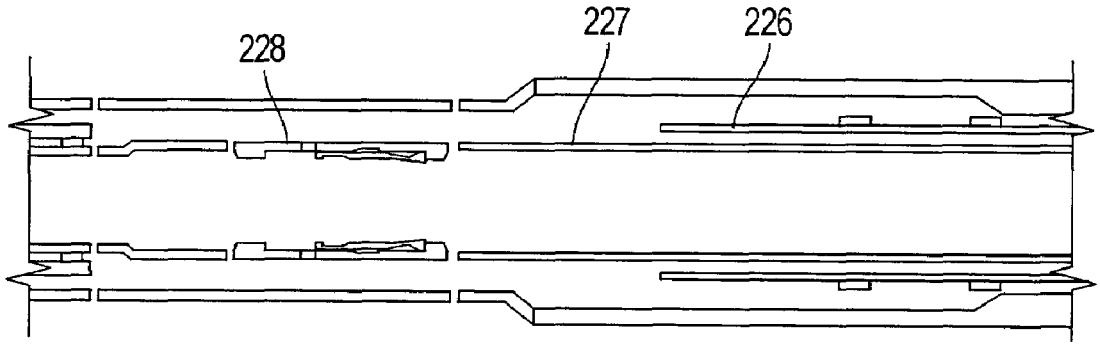
Figure 13D:
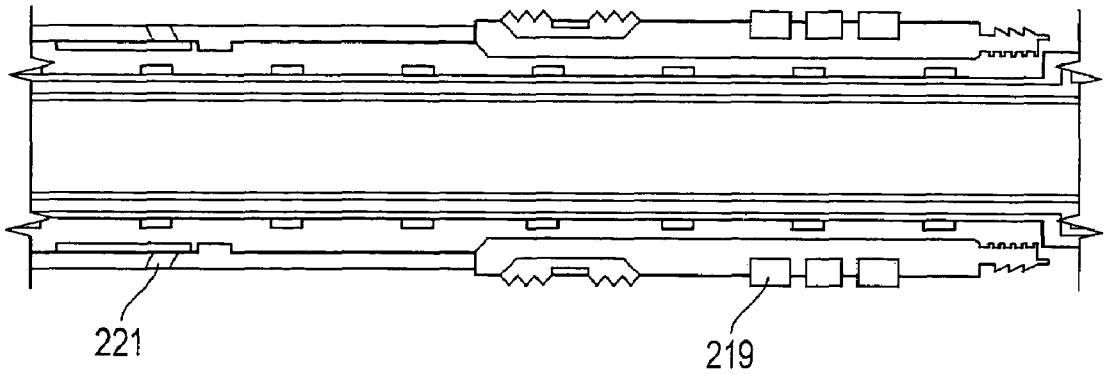
Figure 14D:
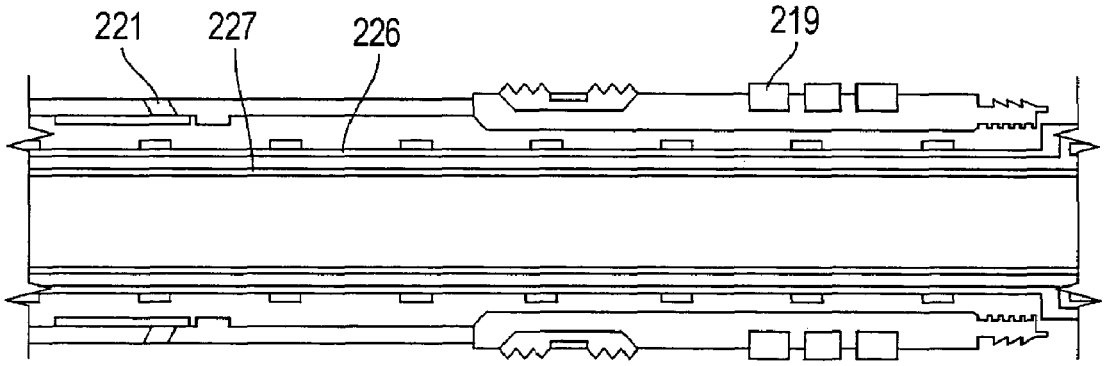
Figure 13E:
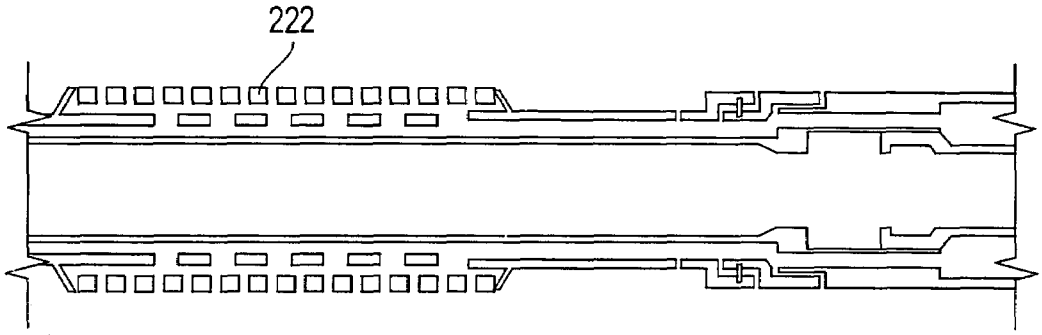
Figure 14E:
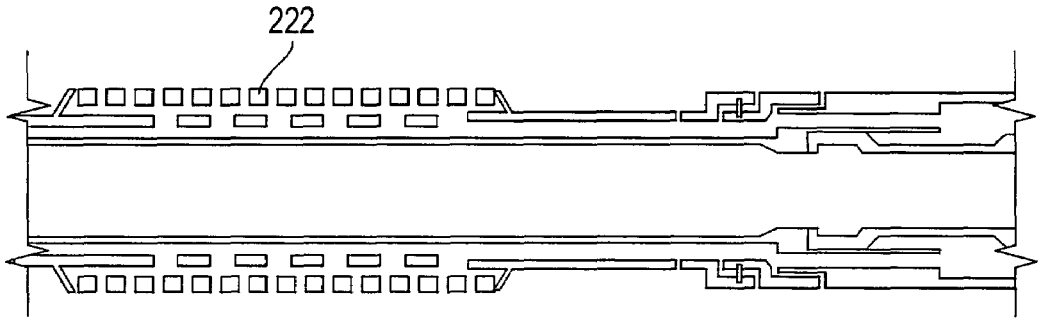
Figure 13F:
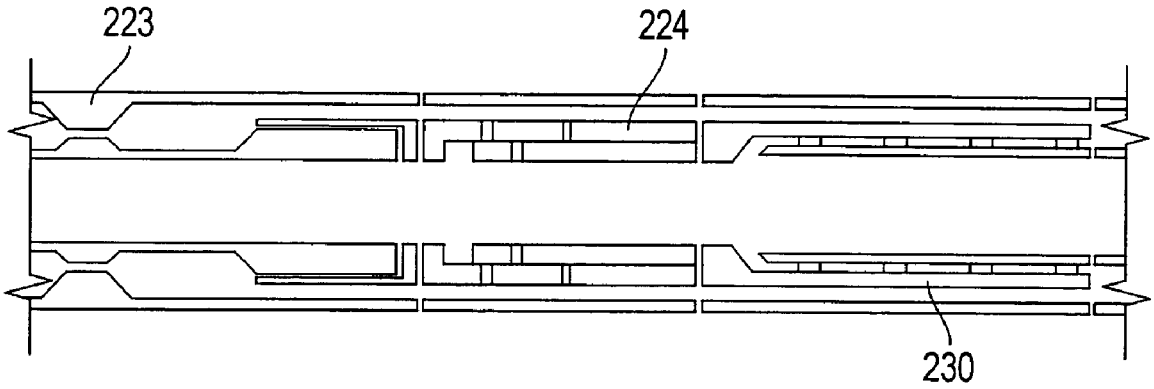
Figure 14F:
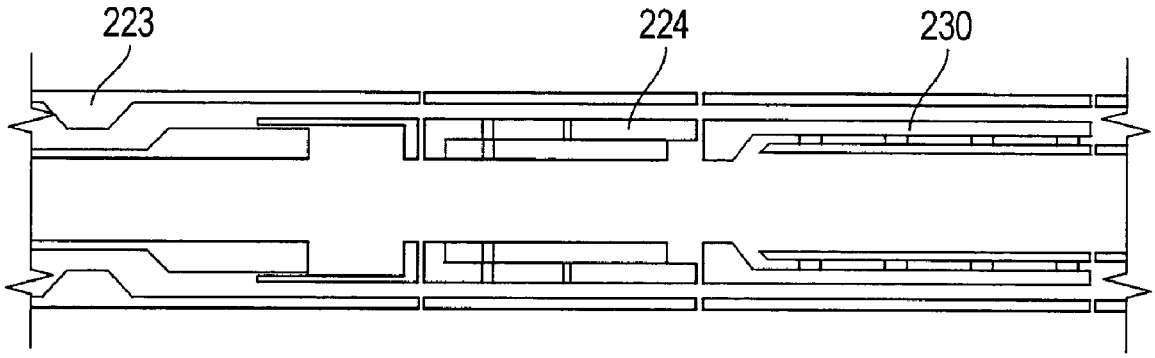
Figure 13G:
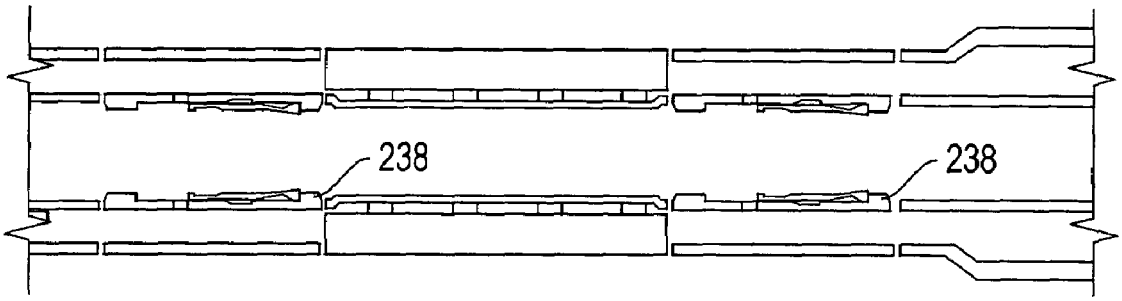
Figure 14G:
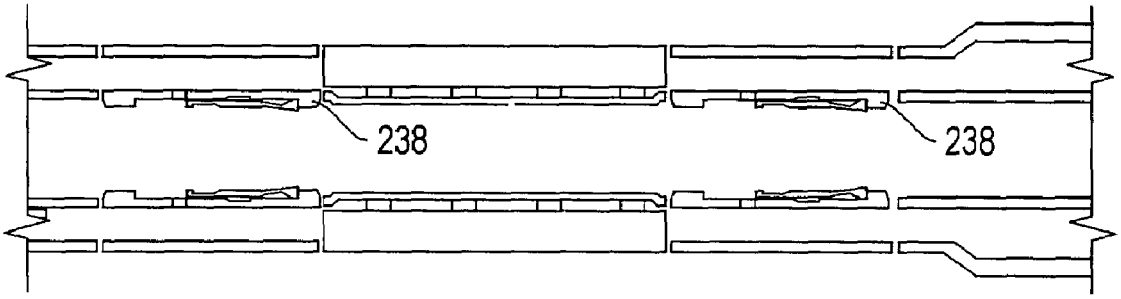
Figure 13H:
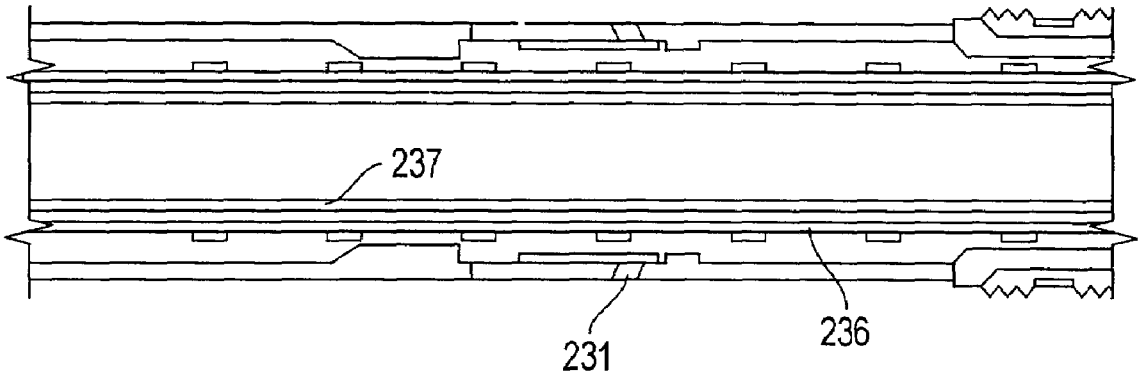
Figure 14H:
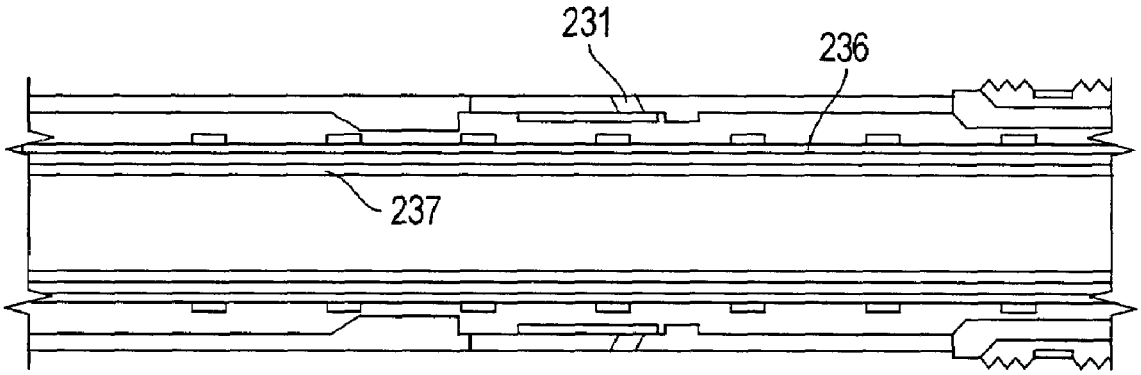
Figure 13I:
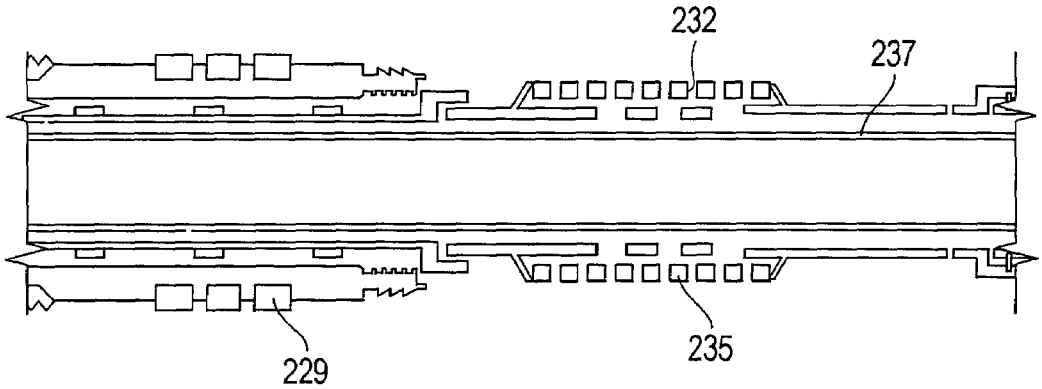
Figure 14I:
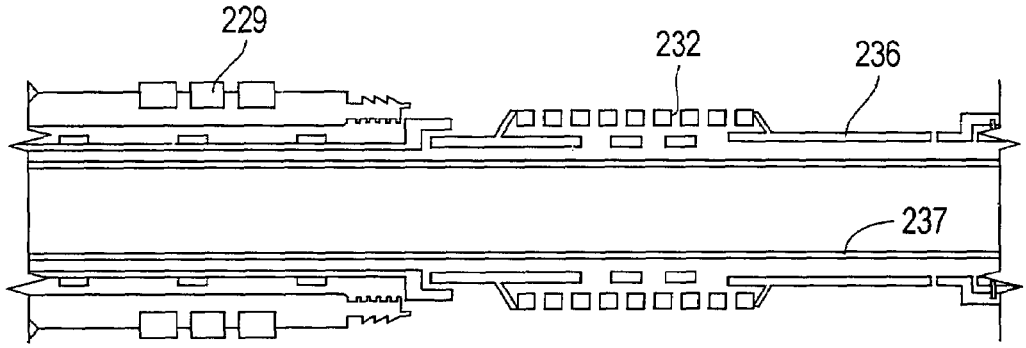
Figure 13J:
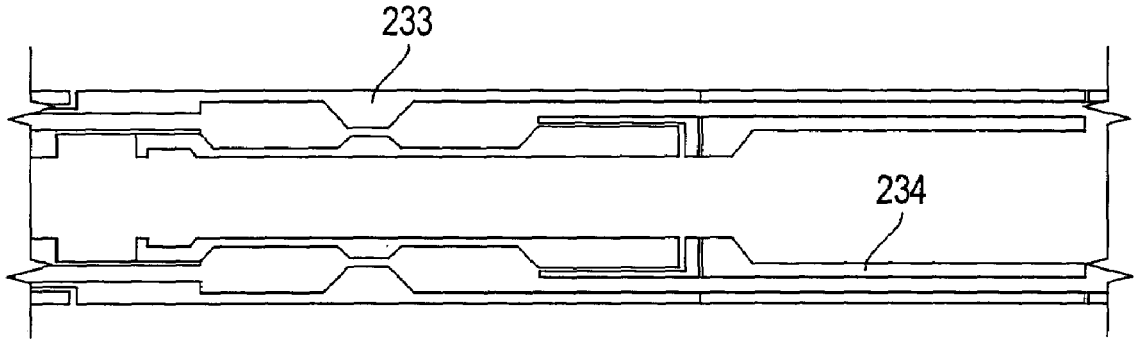
Figure 14J:
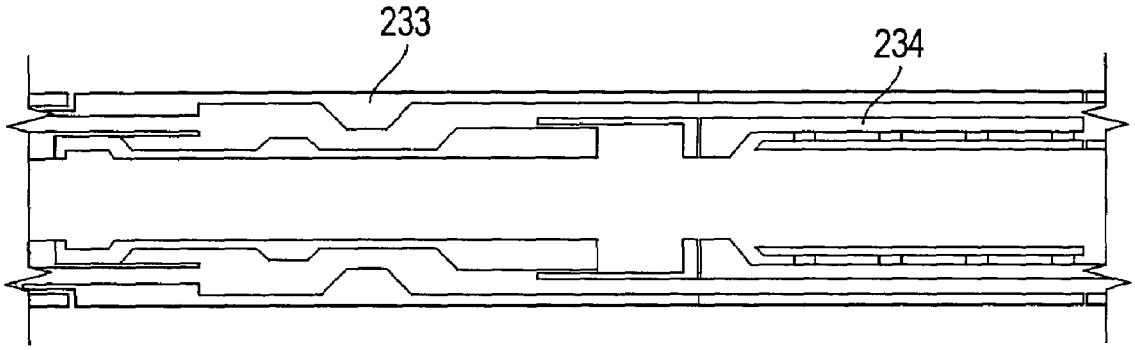
Figure 13K:
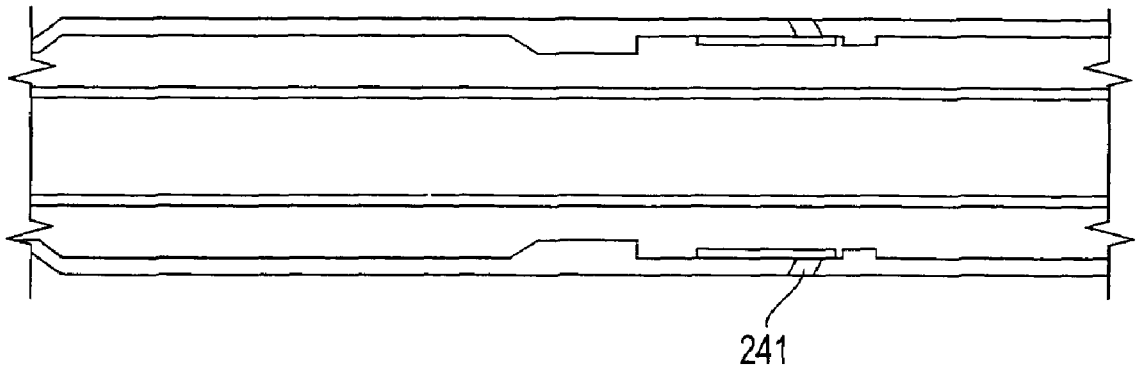
Figure 14K:
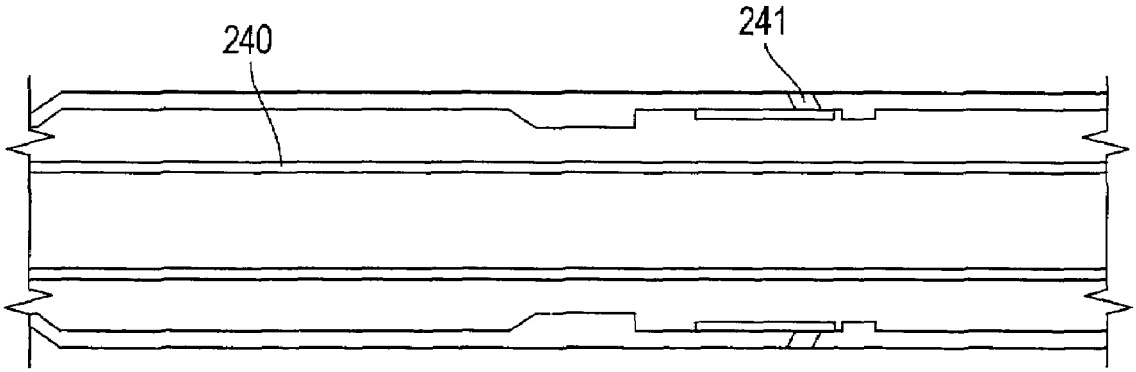
Figure 13L:
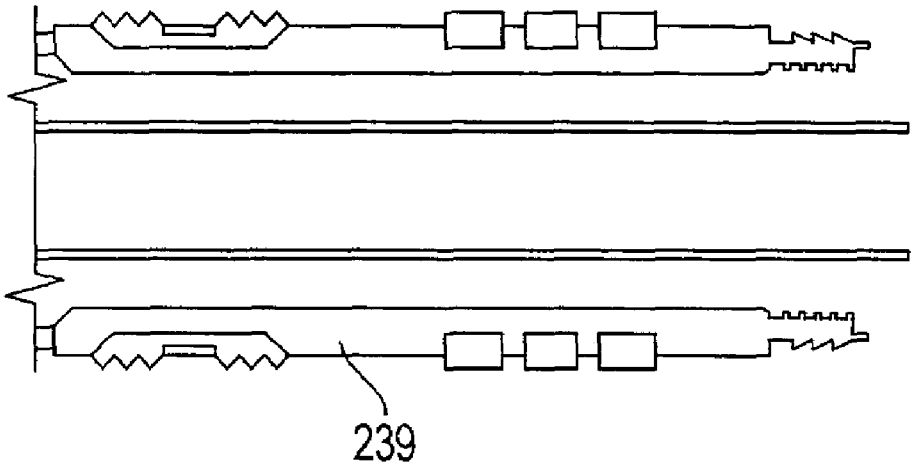
Figure 14L:
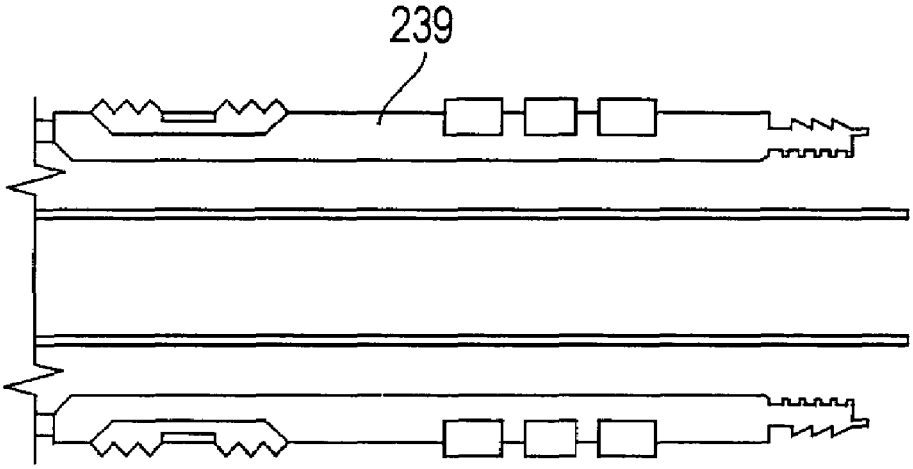

Shown in FIG. 10 is a cross-sectional, diagrammatic view taken along line A—A of FIG. 9C showing the full assembly.

Although only a single preferred PAC valve embodiment of the invention has been shown and described in the foregoing description, numerous variations and uses of a PAC valve according to the present invention are contemplated. As examples of such modification, but without limitation, the valve connections to the production tubing may be reversed such that the inner sleeve moves down hole to the open configuration. In this configuration, use of a spring 180 may not be required as the weight of the inner sleeve may be sufficient to move the valve to the open configuration. Further, the inner sleeve may be connected to the production tubing and the outer sleeve may be slidable disposed about the inner sleeve. A further contemplated modification is the use of an internal mechanism to engage a shifting tool to allow tools to manipulate the valve if necessary. In such a configuration, locking ring 168 may be replaced by a moveable lock that could again lock the valve in the closed configuration. Alternatively, spring 180 may be disengageable to prevent automatic reopening of the valve.

Further, use of a PAC valve according to the present invention is contemplated in many systems. One such system is the ISO System described in U.S. Pat. No. 5,609,204; the disclosure therein is hereby incorporated by reference. A tool shiftable valve may be utilized within the production screens to accomplish the gravel packing operation. Such a valve could be closed as the crossover tool string is removed to isolate the formation. The remaining production valves adjacent the production screen may be pressure actuated valves according to the present invention such that inserting a tool string to open the valves is unnecessary.

FIGS. 11 through 14 illustrate several steps in the construction of an isolation and production system according to an embodiment of the present invention.

FIGS. 11A through 11D show a first isolation string 211, wherein the uphole end is on the right and the downhold end is on the left. The isolation string comprises a PAD valve 212. At the lower end of the isolation string 211, there is a lower packer 210 and at the upper end of the isolation string 211 there is an upper packer 219. A base pipe 216 is connected to the lower packer 210 and has a production screen 215 therearound. The isolation string 211 further comprises an isolation valve 218 on a isolation pipe 217. The PAD valve 212 enables fluid communication through the annulus between the isolation pipe 217 and the isolation string 211. The first isolation string 211 also comprises a sub 214 attached to the top of the PAD valve 212. Further, in the base pipe section between the PAD valve 212 and the upper packer 219, there is a cross-over valve 221. This configuration of the first isolation string 211 enables the first production zone 1 to be fractured, gravel packed, and isolated through the first isolation string 211. In the run-in configuration, the isolation valve 218 is open and the PAD valve 212 is closed. Upon completion of these procedures, the isolation valve 218 is closed to isolate the production zone 1. Later production may begin by opening the PAD valve 212.

FIGS. 12A through 12I show cross-sectional, side views of two isolation strings, wherein the uphole end is on the right and the downhold end is on the left. In particular, a second isolation string 222 is stung inside an isolation string 211. Isolation string 222 comprises a PAD valve 223 and a PAC valve 224. The isolation string 211, shown in this figure, is the same as the isolation string shown in FIG. 11. After the gravel/pack and isolation function are performed on the first zone with the isolation string 211, the isolation string 222 is stung into the isolation string 211. The second isolation string 222 comprises a base pipe 226 having a production screen 225 therearound. The base pipe 226 is stung into the packer 219 of the first isolation string 211. The second isolation string 222 also comprises a isolation pipe 227 which is stung into the sub 214 of the first isolation string 211. The isolation pipe 227 also comprises an isolation valve 228. At the tops of the base pipe 226 and isolation pipe 227, there is connected a PAD valve 223. A PAC valve 224 is connected to the top of the PAD valve 223. Also, a sub 230 is attached to the top of the PAC valve 224. An upper packer 229 is also connected to the exterior portion of the PAD valve 223 through a section of base pipe 226 which also comprises a cross-over valve 231.

Referring to FIGS. 13A through 13L, the isolation strings 211 and 222 of FIG. 12 are shown, wherein the uphole end is on the right and the downhold end is on the left. However, in this figure, a third isolation string 232 is stung into the top of isolation string 222. In this particular configuration, isolation strings 211 and 222 produce fluid from respective zones 1 and 2 up through the annulus between the isolation strings and the isolation sleeves until the fluid reaches the PAC valve 224. The co-mingled production fluid from production zones 1 and 2 pass through the PAC valve 224 into the interior of the production string. The production fluids from zone 3 is produced through the isolation string 232 up through the annulus between the isolation string 232 and the isolation pipe 237. In the embodiment shown in FIG. 13, the PAD valves 212, 223 and 233 are shown in the closed position so that all three of the production zones are isolated. Further, the PAC valve 224 in isolation string 222 is shown in a closed position.

The third isolation string 232 comprises a base pipe 236 which is stung into the packer 229 of the second isolation string. The base pipe 236 also comprises a production screen 235. Inside the base pipe 236, there is a isolation pipe 237 which is stung into the sub 230 of the second isolation string 222. The isolation pipe 237 comprises isolation valve 238. A PAD valve 233 is connected to the tops of the base pipe 236 and isolation pipe 237. A sub 234 is connected to the top of the PAD valve 233. An upper packer 239 is also connected through a section of base pipe 236 to the PAD valve 233. This section of base pipe also comprises a cross-over valve 241.

Referring to FIG. 14A through 14L, the isolation strings 211, 222 and 232 of FIG. 13 are shown, wherein the uphole end is on the right and the downhole end is on the left. In addition to these isolation strings, a production tube 240 is stung into the top of isolation string 232. With the production tube 240 stung into the system, pressure differential is used to open PAD valves 212, 223, and 233. In addition, the pressure differential is used to set PAC valve 224 to an open position. The opening of these valves enables co-mingled production from zones 1 and 2 through the interior of the production tube while production from zone 3 is through the annulus on the outside of the production tube 240. Crossover valve 241, external to tube 240, can be used to facilitate gravel packing a production zone, such process being known in the field.

Figure 15A:
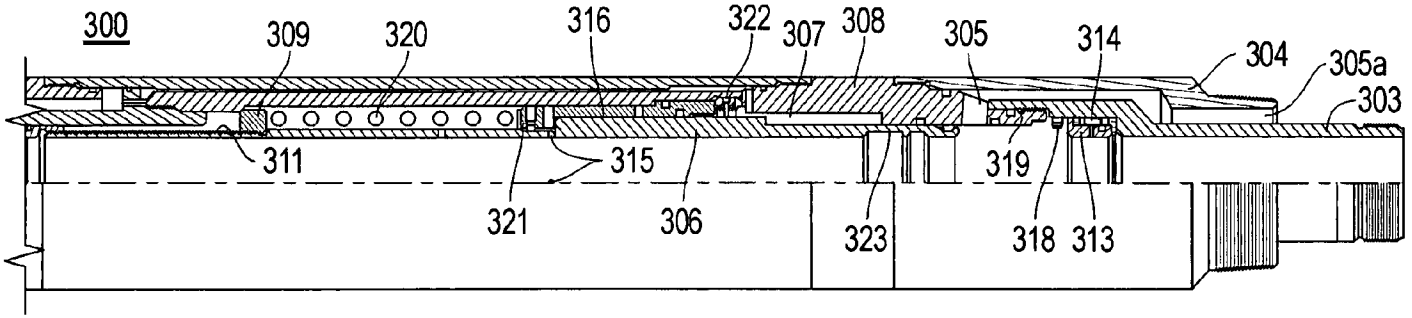
FIGS. 15A–15C show a cross-sectional side view of a Radial Flow Valve (RFV), wherein the valve is in an open configuration.
Figure 16A:
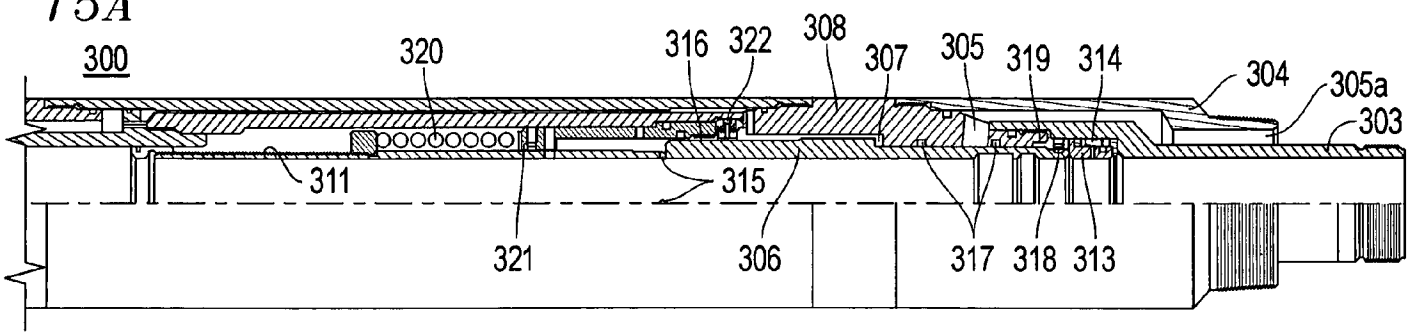
FIGS. 16A–16C show a cross-sectional side view of the RFV of FIGS. 15A–15C, wherein the valve is in an unlocked-closed configuration.
Figure 17A:
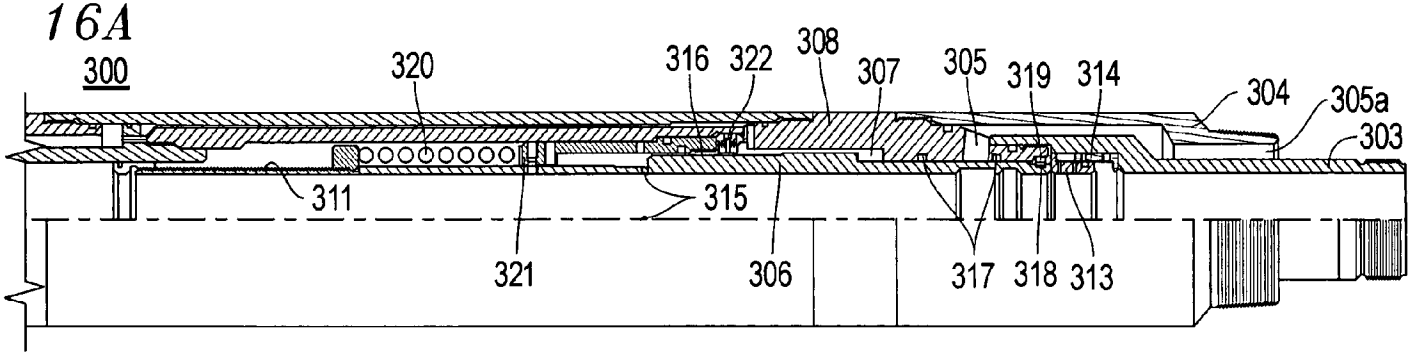
FIGS. 17A–17C show a cross-sectional side view of the RFV of FIGS. 15A–15C, wherein the valve is in a locked-closed configuration.
Figure 15B:
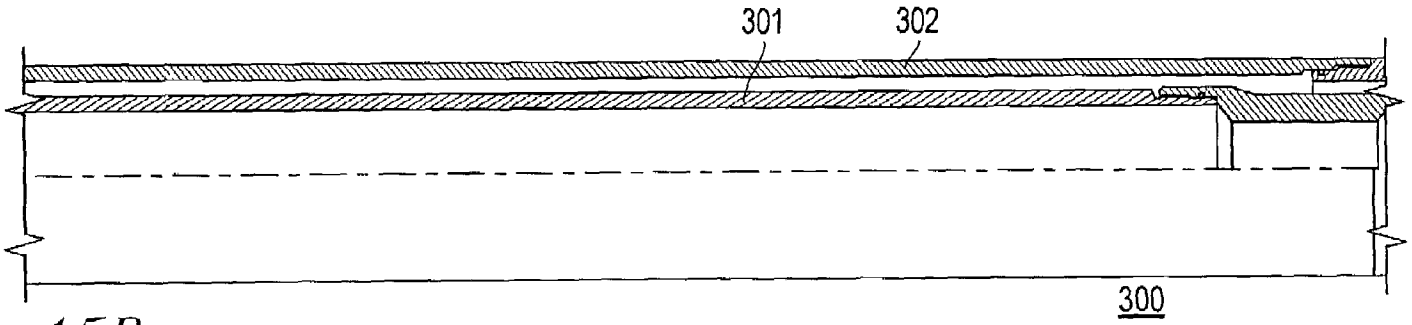
Figure 16B:
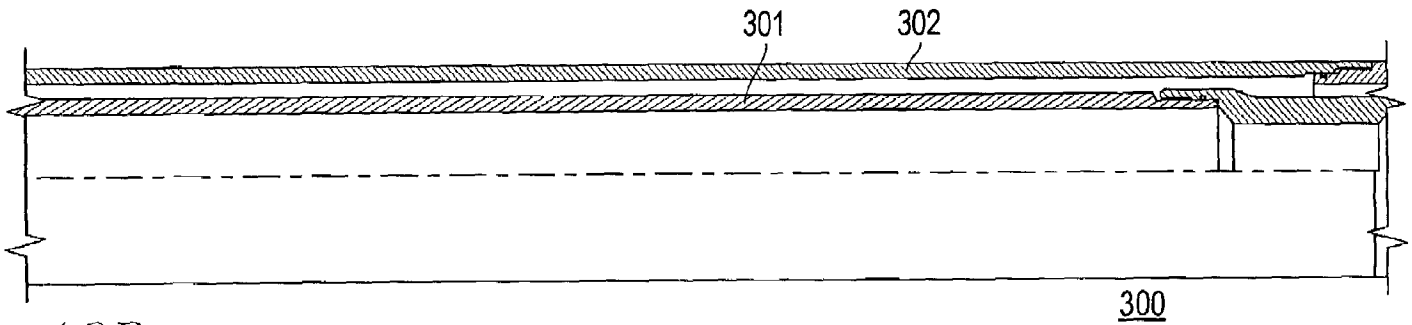
Figure 17B:
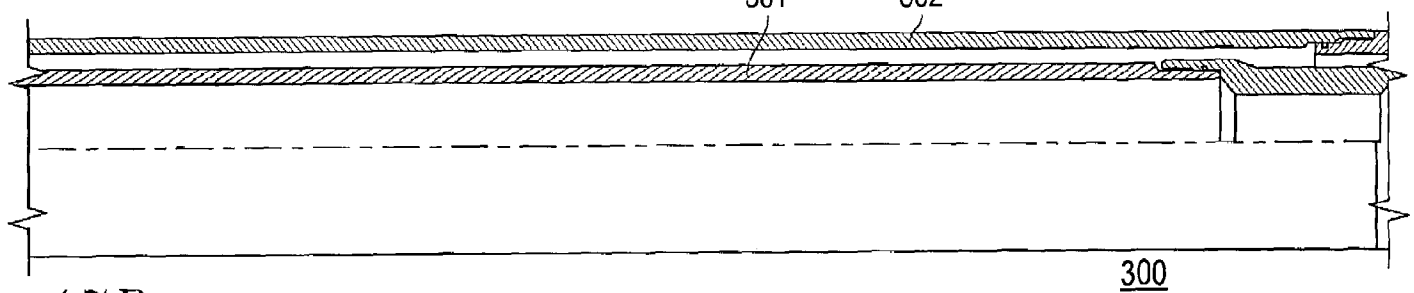
Figure 15C:
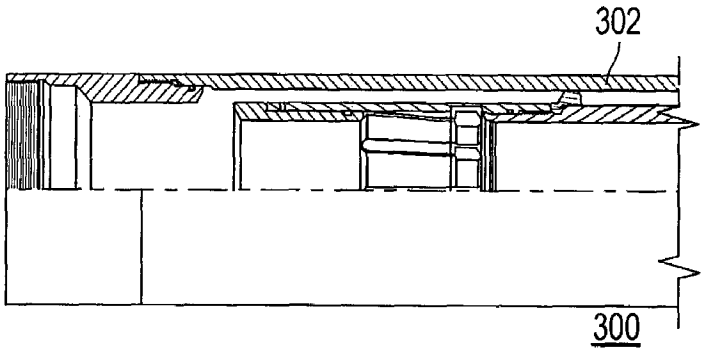
Figure 16C:
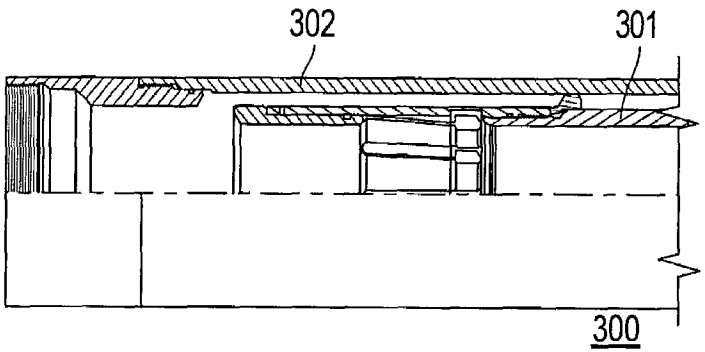
Figure 17C:
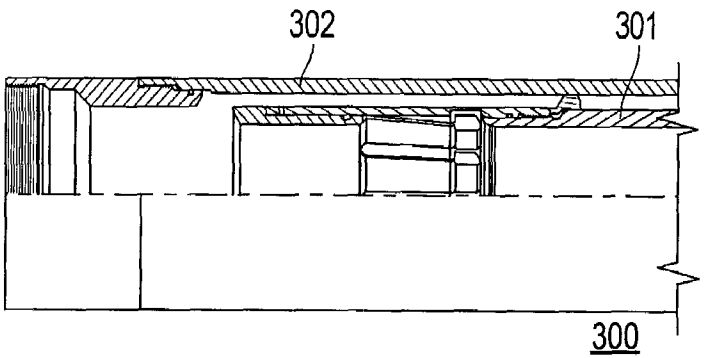

Another double-pin valve is the Radial Flow Valve (RFV), as shown in FIGS. 15A–17C. Similar to the PAD valve or Annular Flow Valve (AFV) shown in FIGS. 5A–6J, the RFV has inner and outer concentric subs. Also, the RFV is pressure activated. In FIGS. 15A–15C, the RFV is shown in an open configuration. In FIGS. 16A–16C, the RFV is shown in a closed, unlocked (sheared) configuration. In FIGS. 17A–17C, the RFV is shown in a closed, locked configuration.

Referring to FIGS. 15A–17C, the a cross-sectional side view of the RFV 300 is shown. The RFV 300 comprises a double-wall construction made up of an inner tube 301 and an outer tube 302. At the bottom of the valve there are inner and outer subs 303 and 304, respectively. A sub annulus 305*a*, forming a fluid flow path therethrough, is defined by the inner and outer subs 303 and 304 to communicate fluid between the subs up to ports 305, which function as a conduit between the sub annulus and an interior of the inner sub. The RFV 300 also has a sleeve 306 which is slidable within the inner tube 301 of the valve. The lower portion of the sleeve 306 is formed to slide over the ports 305 to completely restrict the flow of fluid through the ports 305. A pressure chamber 307 is defined by a portion of the sleeve 305 and a portion of a mounting pipe or ring 308. The inner and outer tubes 301 and 302 are mounted to the top of the mounting pipe 308 and the inner and outer subs 303 and 304 are mounted to the bottom of the mounting pipe 308. The ports 305 extend through the mounting pipe 308. The valve also has a spring-biased lock ring 309 which is a threaded ring which is screwed onto mating threads on sleeve 306. Spring-biased lock ring 309 provides a shoulder so that the spring 320 can push against the sleeve 306.

Typically, the RFV 300 is run in the well in a closed-locked configuration, as shown in FIGS. 17A–17C, wherein the uphole end is on the left and the downhold end is on the right. In the closed-locked configuration, the sleeve 306 covers the ports 305. The RFV 300 is held in the closed-locked configuration by lock ring 313. The lock ring 313 has inner and outer rings which telescope into each other. The lock ring 313 is secured in an extended position by shear screws 314. In the extended position, the shear screws are screwed through both inner and outer rings of the lock ring 313. Because the lock ring 313 is fixed in an extended position, the lock ring 313 and sleeve 306 are unable to slide in the direction of the inner sub 303. The sleeve 306 is also secured to the mounting pipe 308 to prevent it from sliding in the opposite direction of the inner sub 303. The sleeve 306 is secured to the mounting pipe 308 by a snap ring 318, which is spring biased to expand itself radially outward. However, in the closed-locked configuration, the snap ring 318 is held in a groove in the outside, lower end of the sleeve 306 by the lowermost portion of the mounting pipe 308. At the lowermost portion of the mounting pipe 308, there is a shoulder 319 which prevents the snap ring 318, and hence the sleeve 306, from sliding in a direction away from the inner sub 303.

The RFV 300 may be reconfigured to a closed-unlocked (sheared) configuration, as shown in FIGS. 16A–16C, wherein the uphole end is on the left and the downhold end is on the right. The RFV 300 is unlocked by creating a pressure differential between the inner diameter of the sleeve 306 and the pressure chamber 307. Fluid from the inner diameter bleeds through ports 315 in the sleeve 306 to work against annular wall 316. The sleeve 306 has a greater outside diameter above the pressure chamber 307 than it has below the pressure chamber 307. Thus, a relatively higher fluid pressure in the inner diameter of the sleeve 306 compared to the pressure chamber 307, drives the sleeve 306 toward the inner sub 303. As the sleeve 306 slides toward the inner sub 303, it bears on the lock ring 313. When the downward force becomes great enough, the lock ring 313 shears the shear screws 314 to release the inner and outer rings of the lock ring 313 so they are able to collapse into each other. Upon release, the lock ring 313 collapses and the sleeve 306 continues to move downwardly until they come to rest in the closed-unlocked (sheared) configuration shown in FIGS. 16A–16C. As the sleeve 306 moves downward, the snap ring 318 is pushed into a larger bore and expands out of the groove in the sleeve 306 to release the sleeve 306 from the mounting pipe 308. In this position, the snap ring 318 holds the lock ring 313 in its sheared position. This RFV configuration is closed because the sleeve 306 is over the ports 305 to completely restrict the flow of fluid through the ports 305. Seals 317 are positioned above and below the ports 305 to ensure the integrity of the valve.

The RFV 300 also has a spring 320 which works between the lock ring 309 and a seal sleeve 321 to bias the sleeve 306 in the direction away from the inner sub 303. As noted above, the lock ring 309 is secured to the sleeve 306 by threads 311 on the mating surfaces. In the closed-unlocked configuration of the RFV 300, the spring 320 is fully compressed, as shown in FIG. 16A.

FIGS. 15A–15C illustrate the RFV 300 in an open configuration, wherein the uphole end is on the left and the downhold end is on the right. The valve is opened by reducing the pressure differential between the inner diameter of the sleeve 306 and the pressure chamber 307. When this pressure differential is reduced, the spring 320 pushes the sleeve 306 away from the ports 305 in a direction opposite from the inner sub 303 until the ports 305 are uncovered and until a shoulder on sleeve 306 engages a shoulder on seal sleeve 321. The valve also has a ratchet lock ring 322 between the mounting pipe 308 and the sleeve 306. As the sleeve 306 is pushed by the spring 320, the ratchet lock ring 322 jumps over the teeth on the sleeve 306 as it moves into the open position. Because of the configuration of the threads on the ratchet lock ring 322 and sleeve 306, the sleeve 306 is held in the open position by the ratchet lock ring 322 regardless of subsequent changes in the pressure differential.

Alternately, the RFV 300 may be opened by engaging the inner diameter profile 323 in the sleeve 306 with any one of several commonly available wireline or coiled tubing tools (not shown). Applying a downward force to the sleeve 306 shears the shear screws 314 and releases the snap ring 318. The spring 320 then pushes the sleeve 306 away from the ports 305 into the open position as described above. The wireline or coiled tubing tool is then released from the inner diameter profile 323 and removed from the well.

Figure 1B:
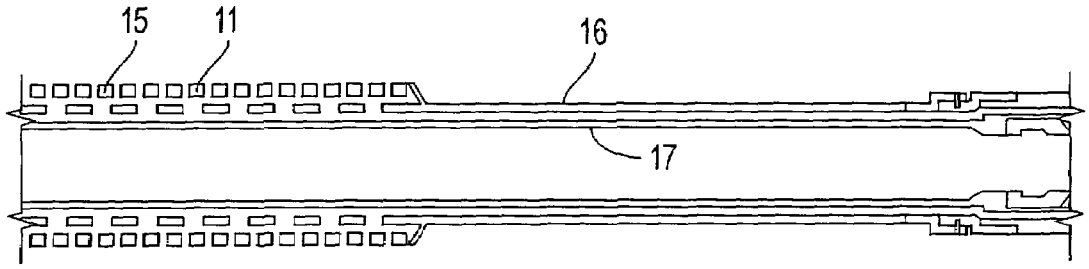
Figure 1C:
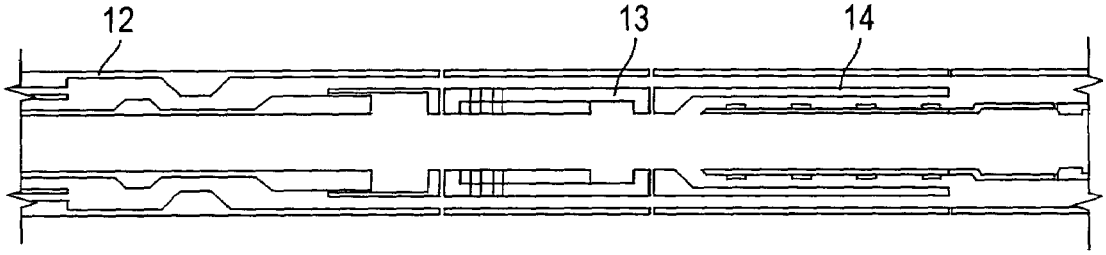
Figure 2C:
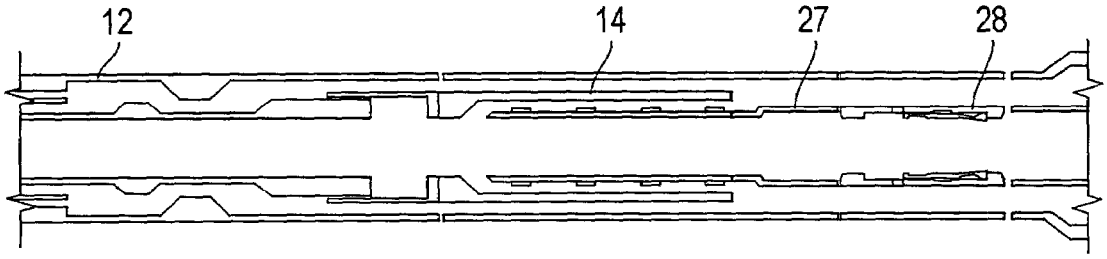
Figure 3C:
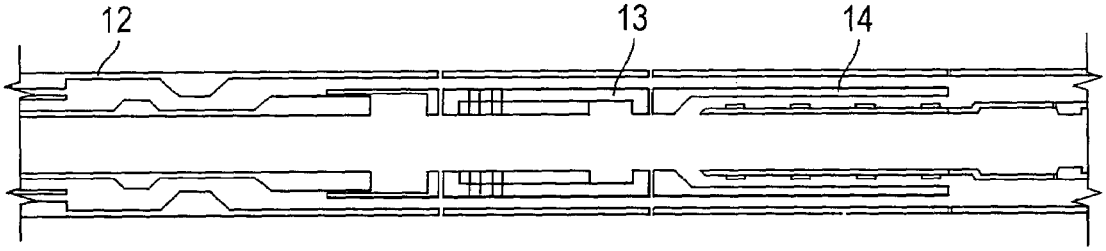
Figure 1D:
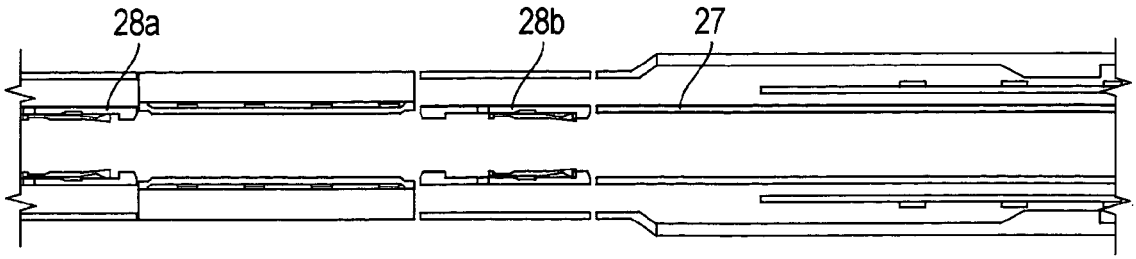
Figure 2D:
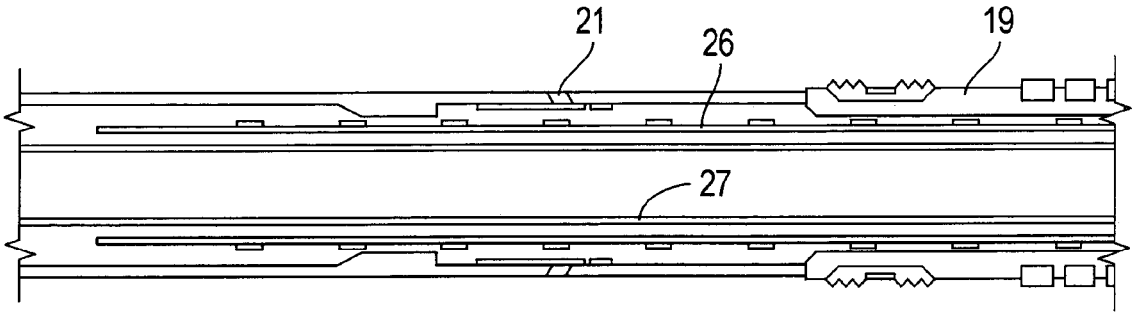
Figure 3D:
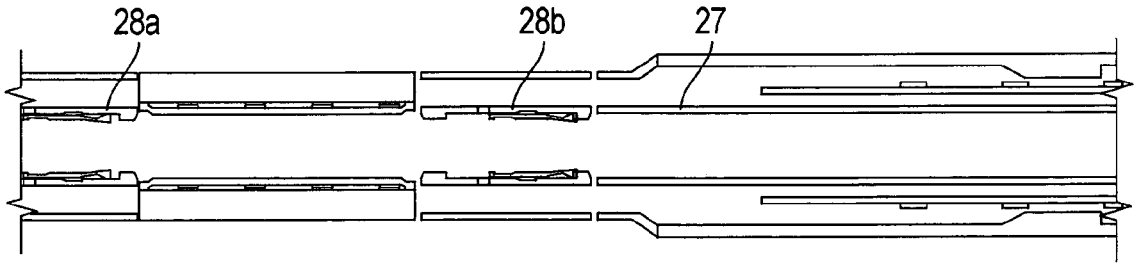
Figure 1E:
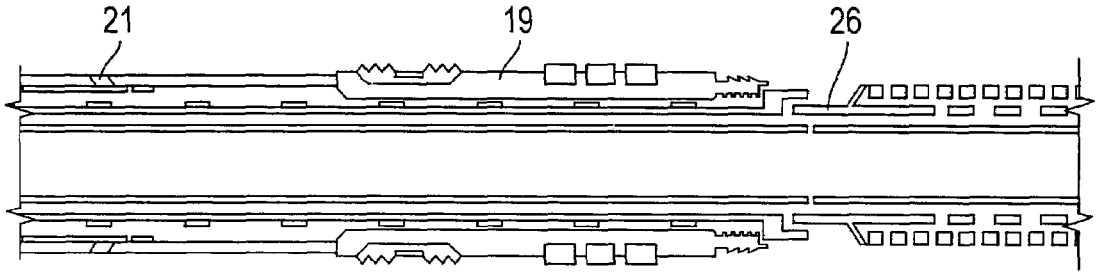
Figure 2E:
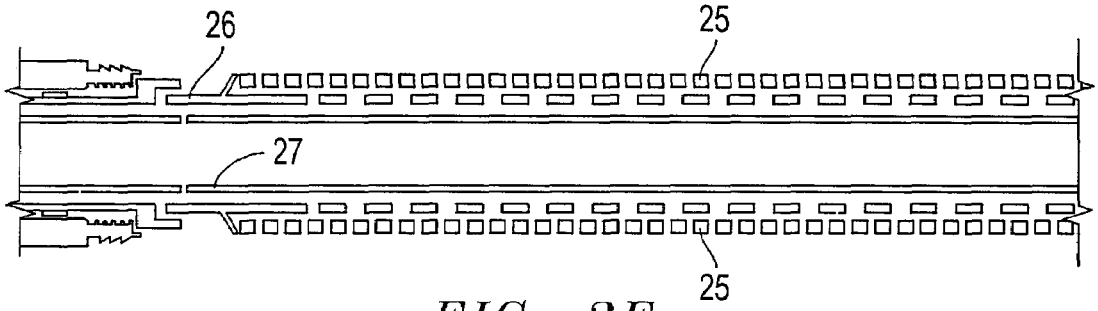
Figure 3E:
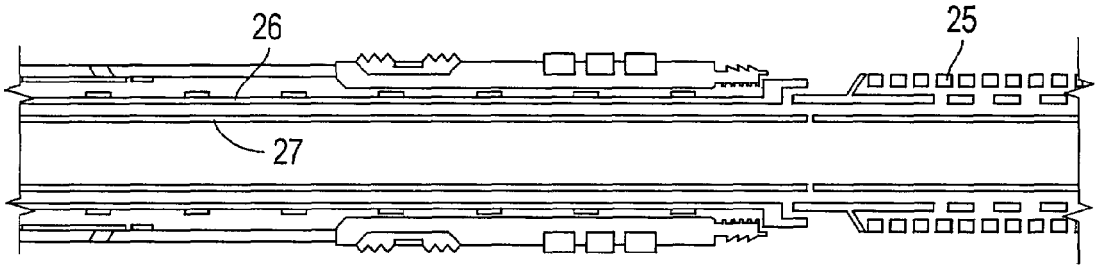
Figure 1F:
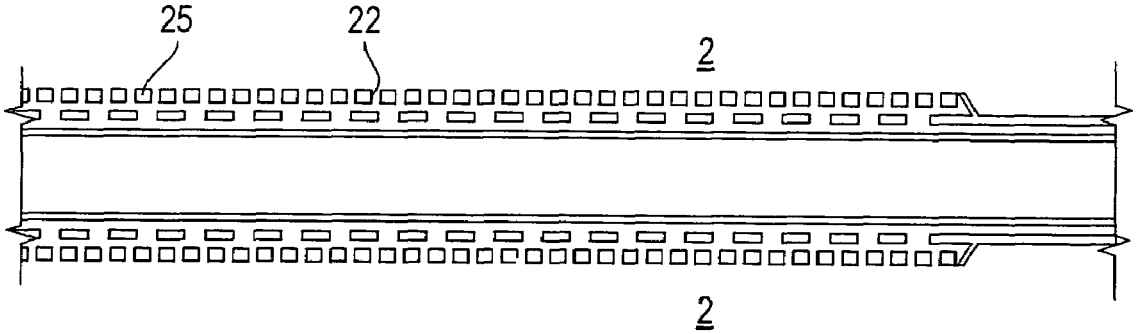
Figure 2F:
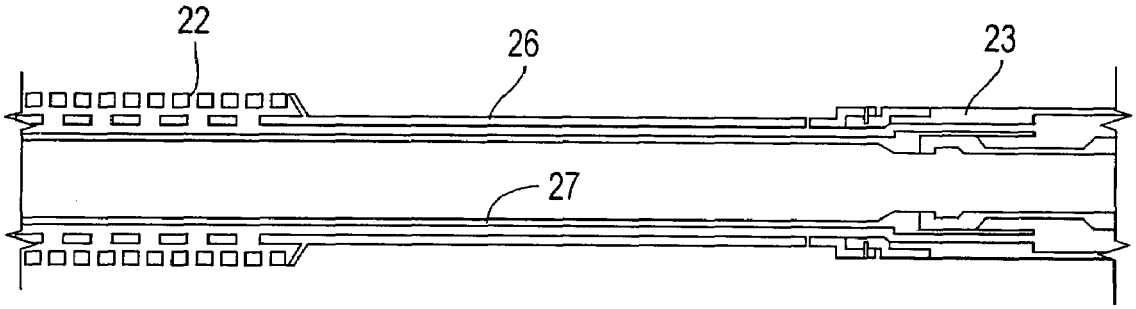
Figure 3F:
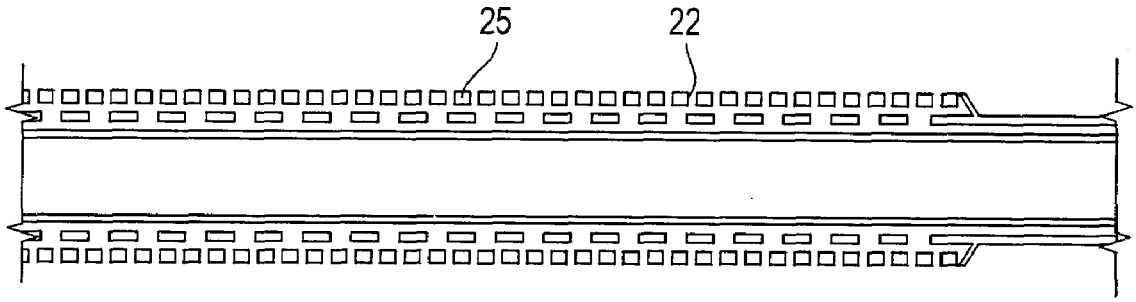
Figure 1G:
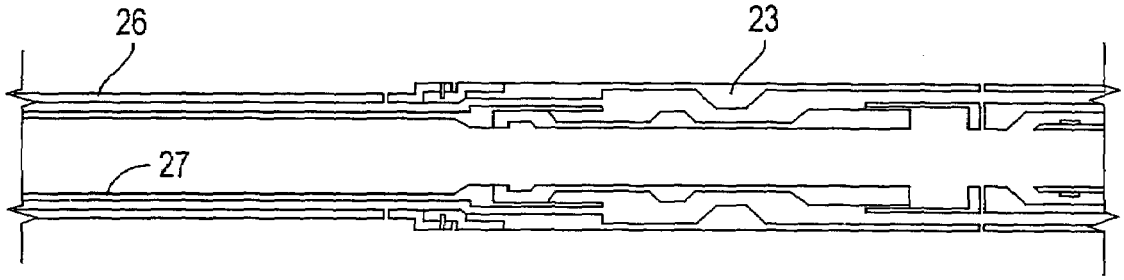
Figure 2G:
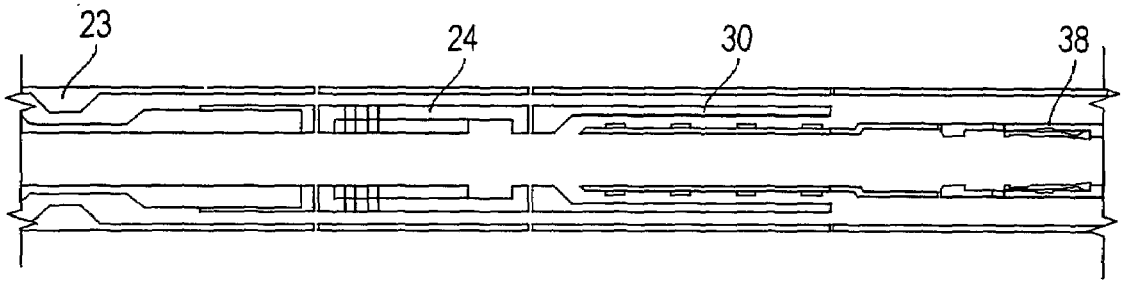
Figure 3G:
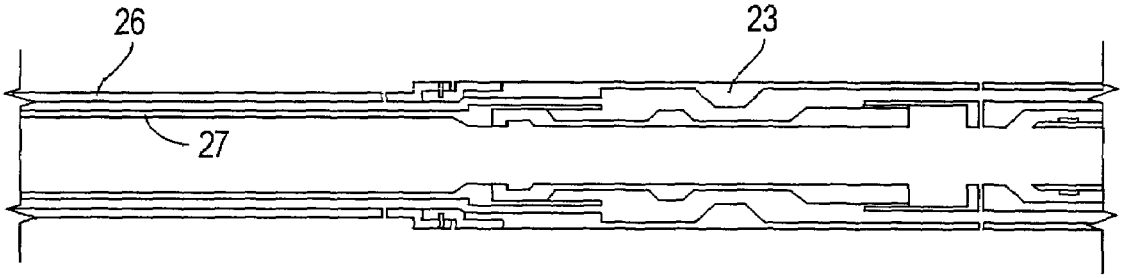
Figure 1H:
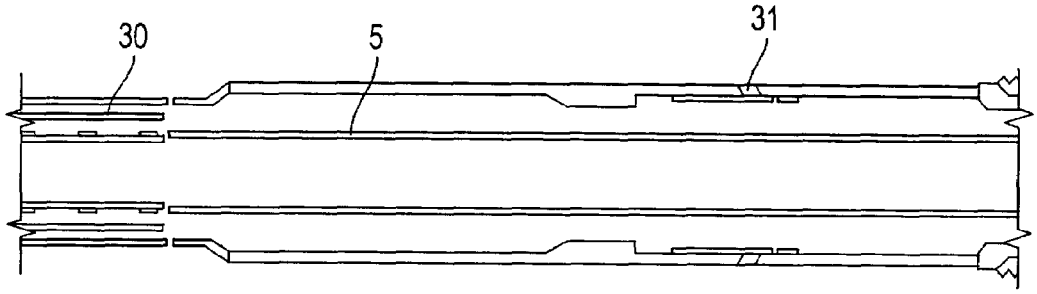
Figure 2H:
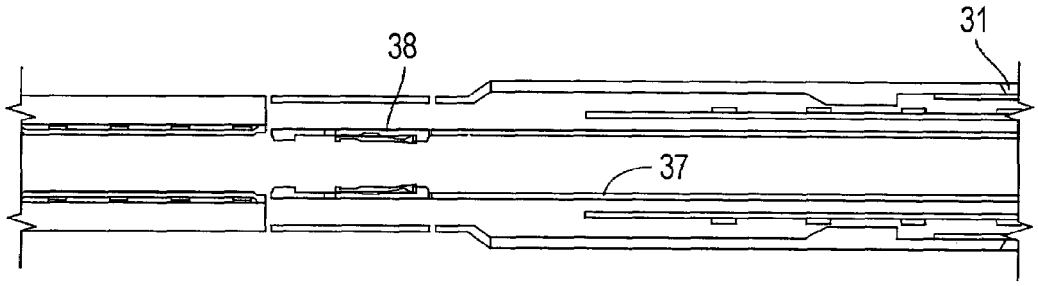
Figure 3H:
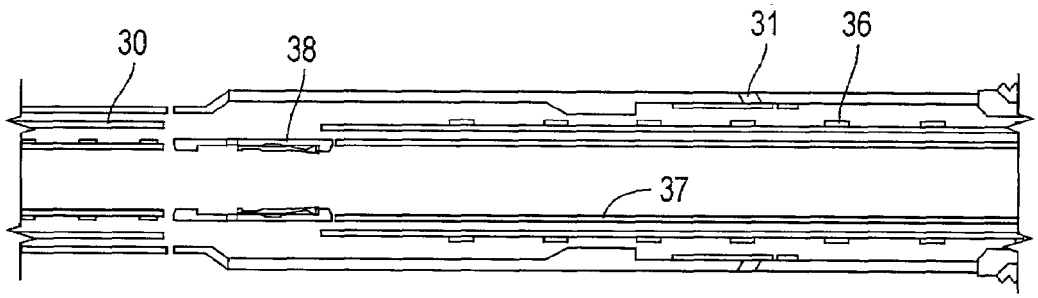
Figure 1I:
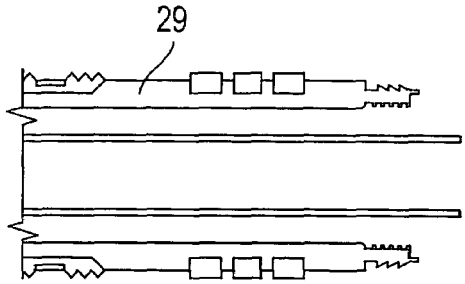
Figure 2I:
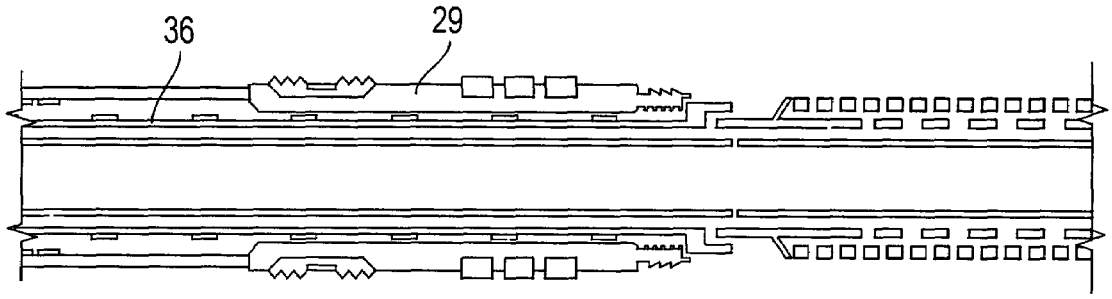
Figure 3I:
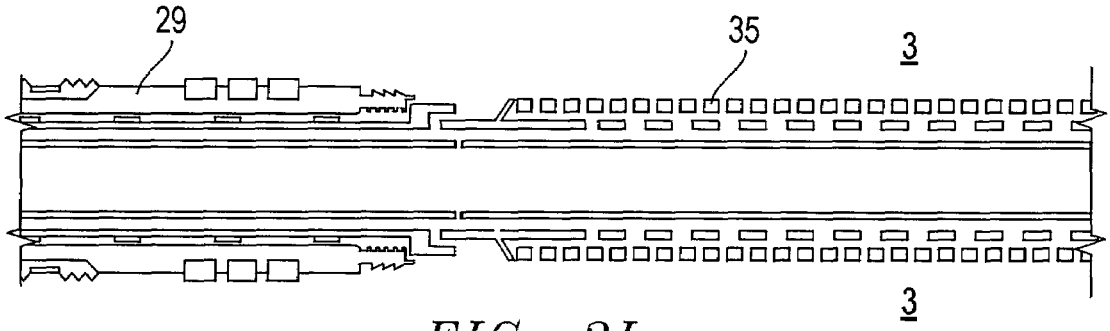
Figure 2J:
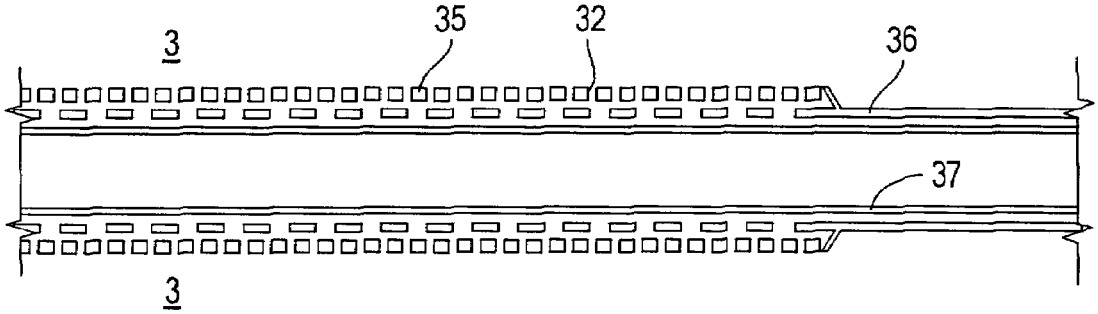
Figure 3J:
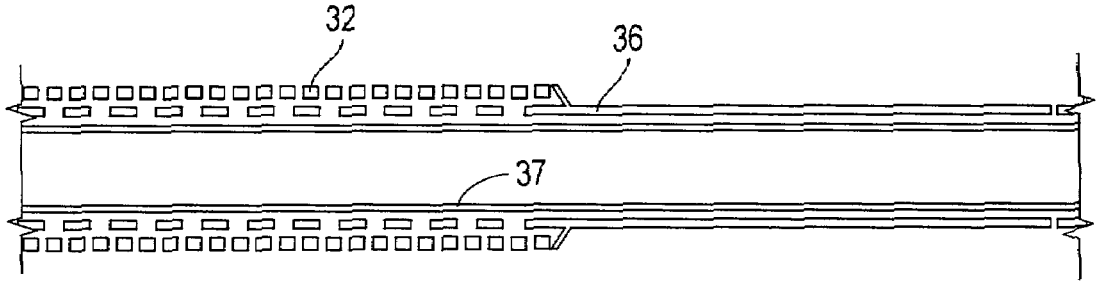
Figure 2K:
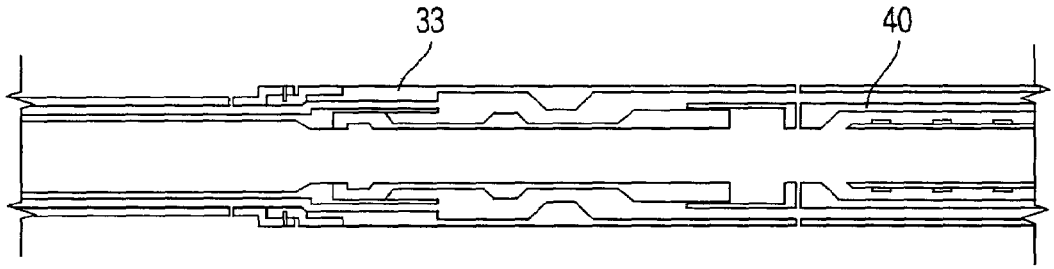
Figure 3K:
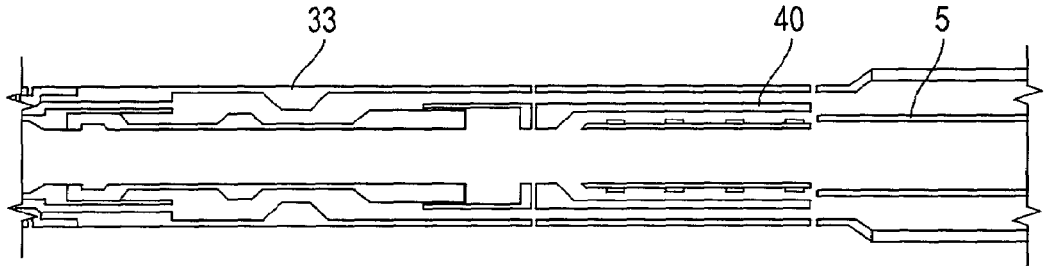
Figure 2L:
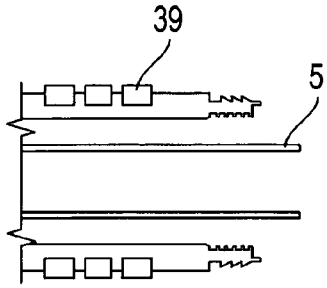

The RFV 300 may be used in an isolation string such as that illustrated in FIG. 1C. In particular, the RFV 300 may replace the combination of a PAD valve 12 and a PAC valve 13 (see FIG. 1C). The PAD valve 12 has a double-pin sub configuration both above and below. The PAC valve 13 is made-up to the inner, to sub of the PAD valve 12. The annulus between the inner and outer subs of the PAD valve 12 is closed by a seal bore (see FIG. 1D). Thus, the functionality provided by the combination of a PAD valve 12 and a PAC valve 13 may be accomplished with a single RFV 300. For example, an embodiment of an isolation string with an RFV 300 is illustrated in FIG. 18.

Figure 18:
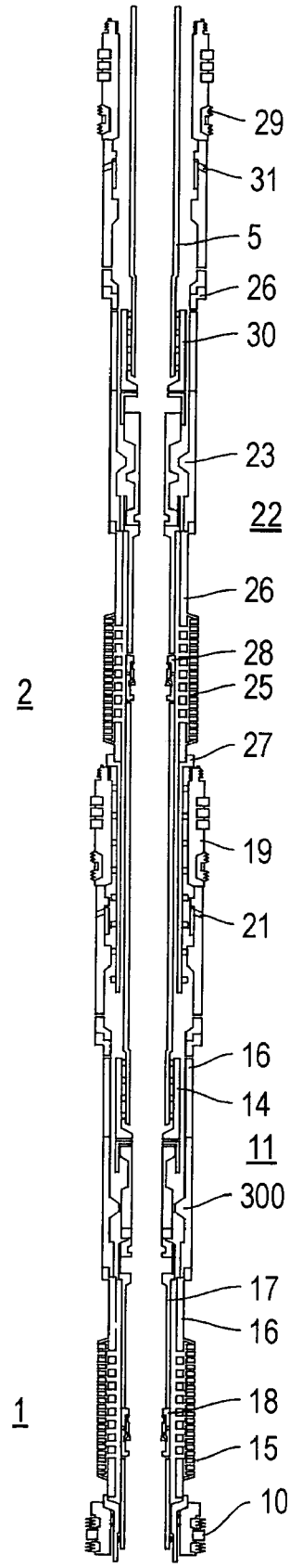
FIG. 18 illustrates a cross-sectional, side view of first and second isolation strings with an RFV.

Referring to FIG. 18, there is shown a system for production-over two separate zones. A first isolation string 11 is placed adjacent the first production zone 1. A second isolation string 22 extends across the second production zone 2. The second isolation string 22 is similar to that shown in FIG. 1, while the first isolation string 11 incorporates the RFV 300. The first isolation string 11 comprises a production screen 15 which is concentric about a base pipe 16. At the lower end of the base pipe 16 there is a lower packer 10 for engaging the first isolation string 11 in the well casing (not shown). Within the base pipe 16, there is a isolation or wash pipe 17 which has an isolation valve 18 therein. The RFV 300 is attached to the tops of both the base pipe 16 and the isolation pipe 17. The RFV 300 allows fluid communication through the annulus below the RFV 300 and the ID of the valve. Further, an upper packer 19 is attached to the exterior of the RFV 300 through a further section of base pipe 16. This section of base pipe 16 has a cross-over valve 21 which is used to communicate fluid between the inside and outside of the base pipe 16 during completion operations.

Once the first isolation string 11 is set in the well casing (not shown) by engaging the upper and lower packers 19 and 10, fracture and gravel pack operations are conducted or may be conducted on the first production zone. The RFV 300 is in a locked closed configuration while the isolation valve 18 and cross-over valve 21 are open. To perform a gravel pack operation, a service tool (not shown) is stung into the top of a sub 14 attached to the top of the RFV 300. The service tool has a washpipe that runs through the PAD valve 12, screen 15 and isolation valve 18. Upon completion of the gravel pack operation, the isolation valve 18 is closed by an isolation valve closure tool attached to the distal end of the washpipe as the washpipe is withdrawn up through the isolation valve 18. The cross-over valve 21 is also closed by the service tool. This isolates the first production zone 1. The service tool (not shown) is then withdrawn from the sub 14. A suitable service tool with washpipe is illustrated in U.S. Pat. No. 5,865,251, issued to Rebardi, et al, on Feb. 2, 1999, incorporated herein by reference. The second isolation string 22 is then stung into the first isolation string 11. The second isolation string comprises a isolation pipe 27 which stings all the way into the sub 14 of the first isolation string 11. The second isolation string 22 also comprises a base pipe 26 which stings into the upper packer 19 of the first isolation string 11. The second isolation string 22 also comprises a production screen 25 which is concentric about the base pipe 26. A PAD valve 23 is connected to the tops of the base pipe 26 and isolation pipe 27. The isolation pipe 27 also comprises isolation valve 28. Attached to the top of the PAD valve 23 is a sub 30 and an upper packer 29 which is connected through a section of pipe. Production tubing 5 is shown stung into the sub 30. The section of base pipe 26 between the packer 29 and the PAD valve 23 also comprises a cross-over valve 31.

With the second isolation string 22 in place, gravel pack procedures are conducted. Upon conclusion, the isolation valve 28 and the cross-over valve 31 are closed to isolate the second production zone 2. The gravel pack equipment is then removed from the well. Both zones remain isolated and there is no fluid loss.

To bring a zone or zones into production, production tubing 5 is then run into the well and stung into sub 30. After the production tubing is installed and surface production equipment is installed, pressure is applied down the ID of production tubing 5. This pressure acts on the PAD valve 23 and the RFV 300 to open the PAD valve 23 and reconfigure the RFV 300 to an unlocked, closed configuration. As the pressure is bled off, the RFV 300 reconfigures to an open configuration. Production from the lower zone 1 then flows through the RFV 300 to the ID of the production tubing 5. Production from the upper zone 2 flows through the PAD valve 23 into the annular space around the production tubing 5. Additional equipment (not shown) located above packer 29 may direct flow from the two zones into two separate production strings, or allow one zone to produce up the annulus between the tubing and the casing, or commingle the two production streams.

The packers, productions screens, isolations valves, base pipes, isolations pipes, subs, cross-over valves, and seals may be off-the-shelf components as are well known by persons of skill in the art.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A valve comprising:

a pipe;

an inner sub connected to the pipe;

an outer sub connected to the pipe, wherein a sub annulus is defined by the inner and outer subs;

a conduit between the sub annulus and an interior of the inner sub;

a closure of the conduit, wherein high fluid pressure within the interior of the inner sub relative to a fluid pressure within the sub annulus reconfigures the closure from a locked-closed configuration to an unlocked-closed configuration, and wherein a lower fluid pressure within the interior of the inner sub relative to the high fluid pressure reconfigures the closure from the unlocked-closed configuration to an open configuration, wherein the closure closes the conduit in the locked-closed and unlocked-closed configurations and the closure does not close the conduit in the open configuration; and a lock which locks the closure in the locked-closed configuration.

2. The valve as claimed in claim 1, wherein the closure comprises a pressure activated sleeve positioned concentrically within the pipe.

3. The valve as claimed in claim 1, wherein the closure comprises a sleeve comprising a section of relatively larger outside diameter and a section of relatively smaller outside diameter which define a pressure area between the diameters.

4. The valve as claimed in claim 1, wherein the lock is pressure activated.

5. The valve as claimed in claim 4, wherein an activation pressure of the lock is a differential pressure between a pressure in the valve interior and a pressure on the outside of the valve.

6. The valve as claimed in claim 1, wherein the lock comprises: telescoping inner and outer rings, and at least one shear fastener which secures the inner and outer rings to each other in an extended position.

7. The valve as claimed in claim 1, wherein the lock comprises a shear fastener connected to the closure.

8. The valve as claimed in claim 1, wherein the lock comprises a snap ring which engages the closure and the pipe.

9. The valve as claimed in claim 1, further comprising a biasing mechanism in mechanical communication with the closure which biases the closure toward the open configuration.

10. The valve as claimed in claim 1, further comprising a second lock of the closure which locks the closure in a locked-open configuration.

11. A valve comprising:

a pipe;

an inner sub connected to the pipe;

an outer sub connected to the pipe, wherein the inner and outer subs are concentric and define a sub annulus there between;

a fluid communication path between the sub annulus and an inside diameter of the inner sub extending through the pipe;

a sleeve slideably positioned within the pipe such that in at least one position the sleeve closes the fluid communication path, wherein the sleeve comprises a section of relatively larger outside diameter and a section of relatively smaller outside diameter which define a pressure area on the sleeve between the diameters; and a lock which locks the sleeve in a position in which the fluid communication path is closed.

12. The valve as claimed in claim 11, wherein a pressure acting on the pressure area of the sleeve unlocks the lock.

13. The valve as claimed in claim 12, wherein an activation pressure of the lock is a differential pressure between a pressure in the valve interior and a pressure on the outside of the valve.

14. The valve as claimed in claim 11, wherein the lock comprises telescoping inner and outer rings, and a fastener which secures the inner and outer rings to each other in an extended position, wherein the fastener fails to secure the rings when a predetermined force compresses the rings.

15. The valve as claimed in claim 11, wherein the lock comprises a shear fastener connected to the sleeve.

16. The valve as claimed in claim 11, wherein the lock comprises a snap ring positioned in a groove of the sleeve, wherein the snap ring engages a shoulder of the pipe to restrict movement of the sleeve.

17. The valve as claimed in claim 11, further comprising a spring in mechanical communication with the sleeve and the pipe, wherein the spring biases the sleeve toward a position which opens the fluid communication path.

18. The valve as claimed in claim 11, wherein a pressure acting on the pressure area on the sleeve biases the sleeve toward a position in which the fluid communication path is closed.

19. The valve as claimed in claim 11, further comprising a second lock of the sleeve which locks the sleeve in a locked-open configuration.

20. A method for controlling fluid flow through a conduit between a sub annulus defined by inner and outer subs and an interior of the inner sub, the method comprising:

unlocking a sleeve positioned within the inner sub in a first closure position relative to the conduit by sliding the sleeve from the first closure position to a second closure position relative to the conduit; and opening the conduit by sliding the sleeve from the second closure position to an open position relative to the conduit.

21. The method as claimed in claim 20, wherein the unlocking comprises over-pressuring the interior of the inner sub to drive the sleeve from the first closure position to the second closure position.

22. The method as claimed in claim 20, wherein the opening the conduit comprises biasing the sleeve toward the open position and relieving the over-pressuring of the interior of the inner sub.

23. A valve comprising:

a pipe;

a first inner sub connected to the pipe;

a first outer sub connected to the pipe, wherein the first inner and outer subs are concentric and define a first sub annulus;

a conduit between the first sub annulus and an inside diameter of the first inner sub;

a sleeve slideably positioned within the pipe such that in at least one position the sleeve closes the conduit, wherein the sleeve comprises a section of relatively larger outside diameter and a section of relatively smaller outside diameter which define a pressure area on the sleeve between the diameters;

a second inner sub connected to the pipe;

a second outer sub connected to the pipe, wherein the second inner and outer subs are concentric and define a second sub annulus, wherein fluid pressure in the second sub annulus communicates with the pressure area on the sleeve; and a lock which locks the sleeve in a position in which the conduit is closed.

24. The valve as claimed in claim 23, wherein a pressure differential between a fluid pressure in the second sub annulus and a fluid pressure in the inside diameter of the second inner sub unlocks the lock and biases the sleeve toward a position in which the conduit is closed.

25. The valve as claimed in claim 23, wherein the lock comprises telescoping inner and outer rings, and a fastener which secures the inner and outer rings to each other in an extended position, wherein the fastener fails to secure the rings when a predetermined force compresses the rings.

26. The valve as claimed in claim 23, wherein the lock comprises a shear fastener connected to the sleeve.

27. The valve as claimed in claim 23, wherein the lock comprises a snap ring positioned in a groove of the sleeve, wherein the snap ring engages a shoulder of the pipe to restrict movement of the sleeve.

28. The valve as claimed in claim 23, further comprising a spring in mechanical communication with the sleeve and the pipe, wherein the spring biases the sleeve toward a position in which the conduit is open.

* * * * *